US011570860B2

(12) United States Patent
Lee et al.

(10) Patent No.: US 11,570,860 B2
(45) Date of Patent: Jan. 31, 2023

(54) LED CONTROL DEVICE AND LIGHTING DEVICE INCLUDING THE SAME

(71) Applicant: SAMSUNG ELECTRONICS CO., LTD., Suwon-si (KR)

(72) Inventors: Bongjin Lee, Hwaseong-si (KR); Changseob Kim, Seoul (KR); June Jang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/410,330

(22) Filed: Aug. 24, 2021

(65) Prior Publication Data

US 2022/0240356 A1 Jul. 28, 2022

(30) Foreign Application Priority Data

Jan. 25, 2021 (KR) ..... 10-2021-0010169

(51) Int. Cl.

| | |
|---|---|
| ***H05B 45/10*** | (2020.01) |
| ***H05B 45/34*** | (2020.01) |
| ***H05B 45/325*** | (2020.01) |
| ***H05B 45/46*** | (2020.01) |

(52) U.S. Cl.

CPC ..... *H05B 45/10* (2020.01); *H05B 45/325* (2020.01); *H05B 45/34* (2020.01); *H05B 45/46* (2020.01)

(58) Field of Classification Search

CPC ..... H05B 45/10; H05B 45/30; H05B 45/325; H05B 45/34; H05B 45/46; H05B 47/00

See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |

(Continued)

FOREIGN PATENT DOCUMENTS

| | | | |
|---|---|---|---|
| KR | 10-2009-0037422 | A | 4/2009 |
| KR | 10-1082218 | B1 | 11/2011 |

(Continued)

*Primary Examiner* — Jimmy T Vu

(74) *Attorney, Agent, or Firm* — Sughrue Mion, PLLC

(57) ABSTRACT

A light emitting diode (LED) control device includes: a power supply connected to a first driving node and a second driving node of an LED driver configured to provide driving power to a light source including a plurality of LEDs; a controller configured to operate by a first internal power voltage output from the power supply, and receive a control command from an external controller; and a switching device connected to the second driving node, and configured to operate by a second internal power voltage output from the power supply and control brightness of the light source based on a control signal which is output from the controller in response to the control command.

20 Claims, 18 Drawing Sheets

(56) References Cited

U.S. PATENT DOCUMENTS

| | | | |
|---|---|---|---|
| 7,208,725 | B2 | 4/2007 | Sherrer et al. |
| 7,288,758 | B2 | 10/2007 | Sherrer et al. |
| 7,319,044 | B2 | 1/2008 | Han et al. |
| 7,501,656 | B2 | 3/2009 | Han et al. |
| 7,709,857 | B2 | 5/2010 | Kim et al. |
| 7,759,140 | B2 | 7/2010 | Lee et al. |
| 7,781,727 | B2 | 8/2010 | Sherrer et al. |
| 7,790,482 | B2 | 9/2010 | Han et al. |
| 7,940,350 | B2 | 5/2011 | Jeong |
| 7,959,312 | B2 | 6/2011 | Yoo et al. |
| 7,964,881 | B2 | 6/2011 | Choi et al. |
| 7,985,976 | B2 | 7/2011 | Choi et al. |
| 7,994,525 | B2 | 8/2011 | Lee et al. |
| 8,008,683 | B2 | 8/2011 | Choi et al. |
| 8,013,352 | B2 | 9/2011 | Lee et al. |
| 8,049,161 | B2 | 11/2011 | Sherrer et al. |
| 8,129,711 | B2 | 3/2012 | Kang et al. |
| 8,179,938 | B2 | 5/2012 | Kim |
| 8,263,987 | B2 | 9/2012 | Choi et al. |
| 8,324,646 | B2 | 12/2012 | Lee et al. |
| 8,399,944 | B2 | 3/2013 | Kwak et al. |
| 8,432,511 | B2 | 4/2013 | Jeong |
| 8,459,832 | B2 | 6/2013 | Kim |
| 8,502,242 | B2 | 8/2013 | Kim |
| 8,536,604 | B2 | 9/2013 | Kwak et al. |
| 8,735,931 | B2 | 5/2014 | Han et al. |
| 8,766,295 | B2 | 7/2014 | Kim |
| 2019/0306949 | A1* | 10/2019 | Murray ..... H05B 45/375 |

FOREIGN PATENT DOCUMENTS

| | | | |
|---|---|---|---|
| KR | 10-2012-0081775 | A | 7/2012 |
| KR | 10-2012-0116201 | A | 10/2012 |
| KR | 10-2015-0051080 | A | 5/2015 |
| KR | 10-1638599 | B1 | 7/2016 |
| KR | 10-1698346 | B1 | 1/2017 |
| KR | 10-2019-0021929 | A | 3/2019 |
| KR | 10-2094860 | B1 | 3/2020 |
| KR | 10-2099202 | B1 | 4/2020 |

* cited by examiner

LED CONTROL DEVICE AND LIGHTING DEVICE INCLUDING THE SAME

CROSS TO REFERENCE TO RELATED APPLICATION

This application claims benefit of priority to Korean Patent Application No. 10-2021-0010169 filed on Jan. 25, 2021 in the Korean Intellectual Property Office, the disclosure of which is incorporated herein by reference in its entirety.

BACKGROUND

Embodiments of the present disclosure relate to an LED control device and a lighting device including the same.

Alight emitting diode (LED) may have low power consumption and a long lifespan, and has rapidly replaced general fluorescent lamps and incandescent lamps. Recently, various types of lighting devices employing an LED as a light source have been developed and marketed, and research into lighting devices having various functions in addition to a simple lighting function have also been actively conducted. For example, a function of controlling a color temperature and/or brightness of light or monitoring an operating state of LEDs mounted as light sources may be included in a lighting device.

SUMMARY

An embodiment of the present disclosure is to provide an LED control device which may reduce frequencies of replacement and/or upgrade of components included in a lighting device, and may implement various functions, and the lighting device including the same.

According to an embodiment, there is provided an LED control device which may include: a power supply connected to a first driving node and a second driving node of an LED driver configured to provide driving power to a light source including a plurality of LEDs; a controller configured to operate by a first internal power voltage output from the power supply, and receive a control command from an external controller; and a switching device connected to the second driving node, and configured to operate by a second internal power voltage output from the power supply and control brightness of the light source based on a control signal which is output from the controller in response to the control command.

According to an embodiment, there is provided a lighting device which may include: an LED driver configured to generate driving power for driving LEDs using AC power, and output the driving power through a first driving node and a second driving node; a light source including at least one LED string comprising the LEDs, and connected between the first driving node and at least one LED node; and an LED control device connected to the first driving node, the second driving node, and the LED node, between the LED driver and the light source, wherein the LED control device includes a controller connected to communicate with an external controller, a switching device connected between the LED node and the second driving node and configured to control the LED string in response to a control signal output from the controller, and a power supply connected to the first driving node and the second driving node and configured to output an internal power voltage for operation of the controller and the switching device.

According to an embodiment, there is provided an LED control device which may include: a power supply connected to a first output terminal and a second output terminal among a plurality of output terminals included in an output harness of an LED driver, and configured to generate a first internal power voltage and a second internal power voltage using driving power output by the LED driver; a controller configured to operate by the first internal power voltage and generate a pulse width modulation (PWM) signal as a control signal, based on a control command received from an external controller; and a switching device connected to the second output terminal, configured to operate by the second internal power voltage, and adjust brightness of at least one of a plurality of LEDs operating by the driving power based on the control signal.

BRIEF DESCRIPTION OF DRAWINGS

Various aspects, features, and advantages of the present disclosure will be more clearly understood from the following detailed description, taken in conjunction with the accompanying drawings, in which.

DETAILED DESCRIPTION

Hereinafter, embodiments of the present disclosure will be described as follows with reference to the accompanying drawings. The embodiments described herein are all example embodiments, and thus, the inventive concept is not limited thereto and may be realized in various other forms. Each of the embodiments provided in the following description is not excluded from being associated with one or more features of another example or another embodiment also provided herein or not provided herein but consistent with the inventive concept. For example, even if matters described in a specific example are not described in a different example thereto, the matters may be understood as being related to or combined with the different example, unless otherwise mentioned in descriptions thereof.

Figure 1:
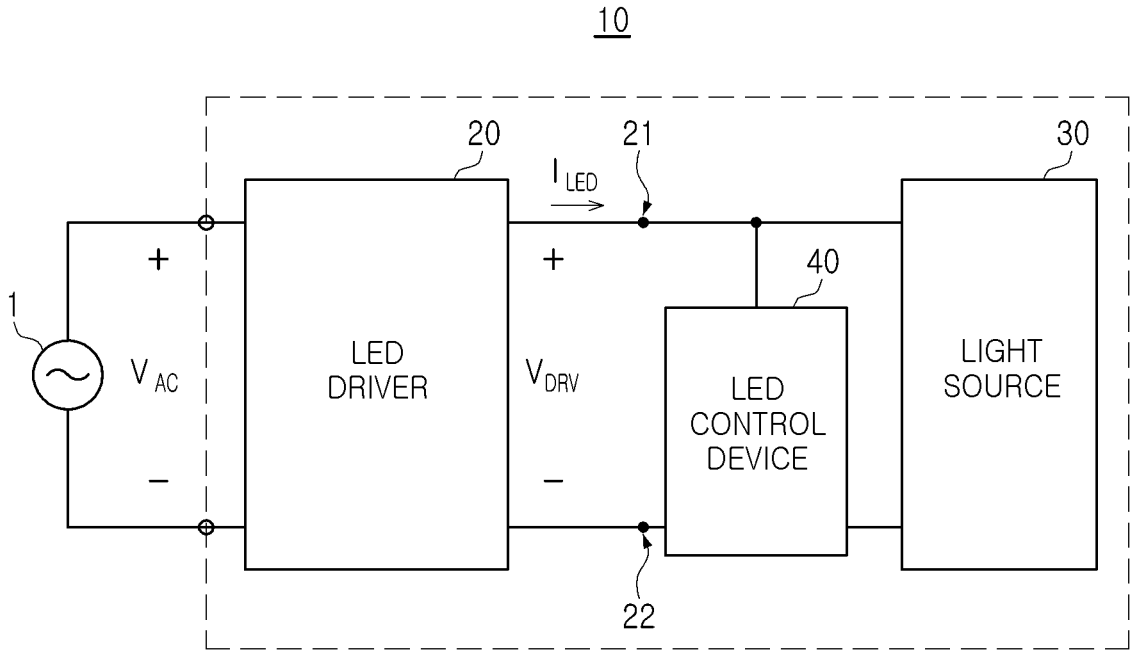
FIG. 1 is a block diagram illustrating a lighting device according to an embodiment.

FIG. 1 is a block diagram illustrating a lighting device, according to an embodiment.

Referring to FIG. 1, a lighting device 10 in an embodiment may include an LED driver 20, a light source 30, and an LED control device 40, connected to a power supply 1. The LED driver 20 may receive AC power $V_{AC}$ output from the power source 1 and may output driving power $V_{DRV}$ for driving LEDs included in the light source 30. For, the LED driver 20 may output a driving current $I_{LED}$ for driving LEDs as a constant current. The LED driver 20 may output driving power $V_{DRV}$ through a first driving node 21 and a second driving node 22.

The LED driver 20 may include a rectifier circuit for rectifying AC power $V_{AC}$ output from the power source 1 to a DC power, and a converter circuit for generating driving power $V_{DRV}$ using the rectified DC power. In embodiments, an electro-magnetic interference (EMI) filter may be further connected between the power supply 1 and the rectifier circuit. The structure and operation of the LED driver 20 will be described later.

The light source 30 may include a plurality of LEDs, and the plurality of LEDs may provide at least one LED string. In embodiments, the plurality of LEDs may include first LEDs configured to emit light having a first color temperature and second LEDs configured to emit light having a second color temperature different from the first color temperature. For example, the first LEDs may output cool white light, and the second LEDs may output warm white light. The first LEDs may provide at least one first LED string, and the second LEDs may provide at least one second LED string. The first LED string and the second LED string may be connected in parallel with each other. The number of LED strings included in the light source 30 is not limited to two.

The LED control device 40 may include a power supply, a controller, and a switching device. The controller may be connected to an external controller, and may generate a predetermined control signal, and the switching device may operate in response to the control signal. For example, the switching device may be directly connected to the light source 30, and may control a plurality of LEDs included in the light source 30 in response to the control signal. The power supply may generate an internal power voltage necessary for operating the controller and the switching device using the driving power $V_{DRV}$.

Figure 2:
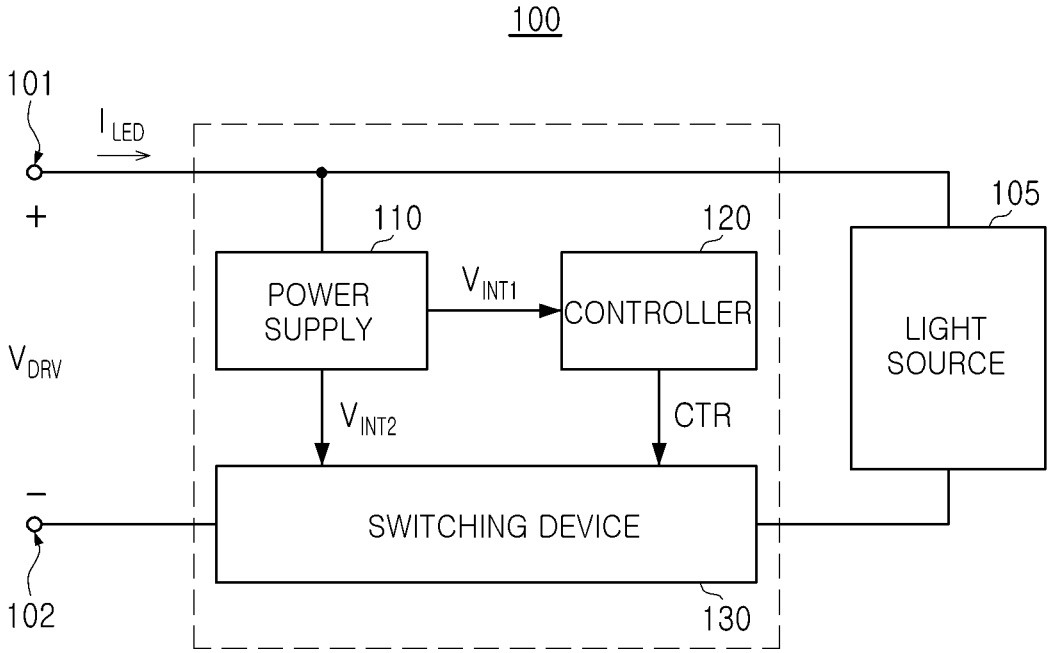
FIG. 2 is a block diagram illustrating an LED control device and a light source, according to an embodiment.

FIG. 2 is a block diagram illustrating an LED control device and a light source, according to an embodiment.

Referring to FIG. 2, an LED control device 100 in an embodiment may include a power supply 110, a controller 120, and a switching device 130. The LED control device 100 may be the same as the LED control device 40 shown in FIG. 1. The power supply 110 may generate internal power voltages $V_{INT1}$ and $V_{INT2}$ necessary for operation of the controller 120 and the switching device 130 using the driving power $V_{DRV}$ output from the LED driver. In embodiments, an operating voltage of the controller 120 may be different from an operating voltage of the switching device 130, the power supply 110 may supply the first internal power voltage $V_{INT1}$ to the controller 120, and may supply the second internal power voltage $V_{INT2}$ to the switching device 130. The power supply 110 may include a first regulator for generating the first internal power voltage $V_{INT1}$, and a second regulator for generating a second internal power voltage $V_{INT2}$.

The controller 120 may operate by receiving the first internal power voltage $V_{INT1}$, and may generate a control signal CTR for controlling the switching device 130. For, the control signal CTR may be a pulse width modulation (PWM) signal. The controller 120 may be connected to communicate with an external controller, and may adjust a duty ratio and/or a frequency of the control signal CTR in response to a control command transmitted from the external controller. For, the controller 120 may adjust a duty ratio of the control signal CTR in response to a dimming command included in the control command. The controller 120 may increase the duty ratio of the control signal CTR when the dimming command is a brightness increase command, and the controller 120 may decrease the duty ratio of the control signal CTR when the dimming command is a brightness decrease command.

In embodiments, the controller 120 may be connected to an external controller through wired or wireless communication, and may receive a control command. For, the controller 120 may be connected to an external controller through wireless communication such as Bluetooth, Zigbee, Wi-Fi, Li-Fi, and infrared communication. Alternatively, the controller 120 may be connected to an external controller through wired communication such as digital addressable lighting interface (DALI) or digital multiplex (DMX). The controller 120 may include a microcontroller unit (MCU), a communication circuit, an antenna, and an oscillator to operate by being connected to an external controller through various wired and wireless communication.

A microcontroller unit of the controller 120 may generate a control signal CTR using a control command received from an external controller through a communication circuit. As described above, the duty ratio and/or frequency of the control signal CTR may be changed according to the control command.

The switching device 130 may be connected to the light source 105. According to an embodiment, the light source 105 may include two or more LED strings connected in parallel with each other, and at least one of the two or more LED strings may be connected to the switching device 130. In an embodiment, the switching device 130 may include a switch connected to the light source 105, and a switch driver for controlling the switch to turn on/off. In embodiments, the number of the switches and the number of the switch drivers included in the switching device 130 may vary. A detailed configuration of the switching device 130 will be described later with reference to FIGS. 3 and 4.

In the embodiment illustrated in FIG. 2, the LED control device 100 and the light source 105 may be implemented on separate package substrates. Accordingly, the LED control device 100 may be selectively added to an existing lighting device implemented by the LED driver and the light source 105, and an additional function provided by the LED control device 100 may be implemented in the lighting device using the components of the existing lighting device as is.

Figure 3:
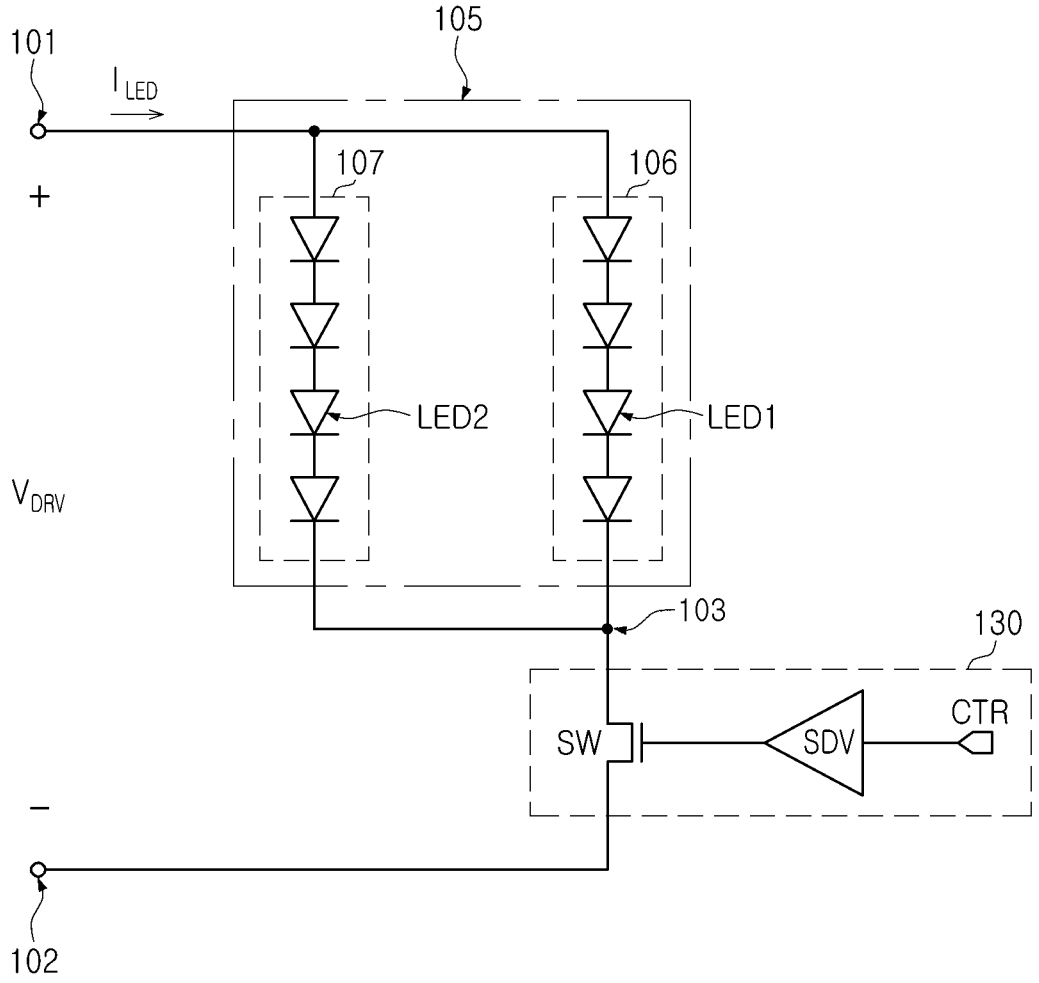
FIGS. 3 and 4 are circuit diagrams illustrating a switch and a light source in reference to FIGS. 1 and 2, according to embodiments.
Figure 4:
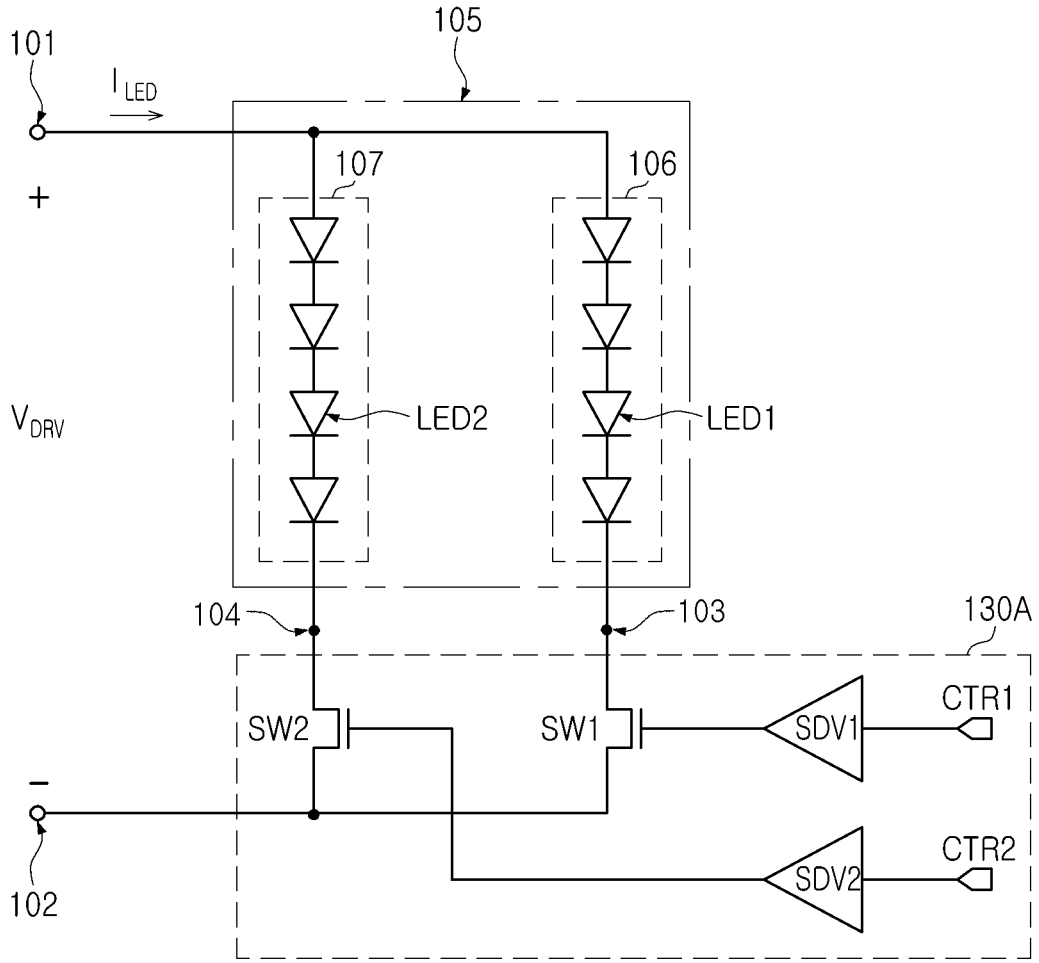

FIGS. 3 and 4 are circuit diagrams illustrating a switch and a light source in reference to FIGS. 1 and 2, according to embodiments.

In the embodiments illustrated in FIGS. 3 and 4, a light source 105 may include a first LED string 106 and a second LED string 107 connected in parallel with each other between the first driving node 101 and an LED node 103. The first LED string 106 may include first LEDs LED1, and the second LED string 107 may include second LEDs LED2. The first LED string 106 and the second LED string 107 may be connected between the first driving node 101 and the second driving node 102 and may receive driving power $V_{DRV}$, and may emit light by a driving current $I_{LED}$ input through a first driving node 101.

Referring to FIG. 3, the switching device 130 may include a switch SW and a switch driver SDV, connected to the second LED string 107. The switch driver SDV may operate by a control signal CTR, and the control signal CTR may be a PWM signal generated by the controller, as described above with reference to FIG. 2.

In the embodiment illustrated in FIG. 3, a turn-on time and a turn-off time of the switch SW may be determined by a duty ratio of the control signal CTR. As the duty ratio of the control signal CTR increases, the turn-on time of the switch SW may increase as compared to the turn-off time, and brightness of the light source 105 may increase. When the duty ratio of the control signal CTR decreases, brightness of the light source 105 may decrease.

In an embodiment, a dimming function for controlling brightness of the light source 105 by adjusting the duty ratio of the control signal CTR input to the switching device 130 may be implemented. In other words, by additionally connecting an LED control device to a lighting device which may not provide the dimming function, a lighting device having the dimming function may be provided, according to an embodiment. Also, since the switching module 130 only includes a single switch SW and a single switch driver SDV, production costs and power consumption of the LED control device may be lowered.

Referring to FIG. 4, a switching device 130A may include a first switch SW1 and a second switch SW2, and a first switch driver SDV1 and a second switch driver SDV2. The first switch SW1 may be connected between a first LED string 106 and a second driving node 102, and the second switch SW2 may be connected between the second LED string 107 and the second driving node 102.

In the embodiment illustrated in FIG. 4, the first switch SW1 may be controlled by the first switch driver SDV1, and the second switch SW2 may be controlled by the second switch driver SDV2. The first switch driver SDV1 may receive a first control signal CTR1, and may control the first switch SW1, and the second switch driver SDV2 may receive a second control signal CTR2 and may control the second device SW2. Accordingly, brightness of each of the first LED string 106 and the second LED string 107 may be independently controlled.

As an, the first LEDs LED1 and the second LEDs LED2 may output light of different color temperatures or light of different colors. As in the embodiment illustrated in FIG. 4, by independently controlling brightness of each of the first LED string 106 and the second LED string 107 using the first switch SW1 and the second switch SW2 through a first LED node 103 and a second LED node 104, respectively, a user may adjust a color, brightness, and a color temperature of light output from the light source 105.

In an embodiment, the first LED string 106 may output cool white light, and the second LED string 107 may output warm white light. As an, when it is assumed that the first color temperature of the light output from the first LED string 106 is 6000K, which may be a cool white color, and the second color temperature of the light output from the second LED string 107 is 2700K, which may be a warm white color, the color temperature CCT of light output from the light source 105 may be determined as in Table 1 depending on the duty ratio of the first control signal CTR1 which may determine the first switch SW1 to turn on/off and the duty ratio of the second control signal CTR2 which may determine the second switch SW2 to turn on/off.

TABLE 1

| Duty ratio of first control signal | Duty ratio of second control signal | Color temperature of light |
|---|---|---|
| 100% | 0% | 6000K |
| 75% | 25% | 5175K |
| 50% | 50% | 4350K |
| 25% | 75% | 3525K |
| 0% | 100% | 2700K |

The operation in Table 1 as an example may be implemented with a switching device having a configuration different from the embodiment described with reference to FIG. 4. As an example, by implementing the first switch SW1 as an NMOS transistor and implementing the second switch SW2 as a PMOS transistor and by connecting an output terminal of a single switch driver to a gate of the first switch SW1 and the second switch SW2, the operation described with reference to Table 1 may be implemented. In this case, the operation described with reference to Table 1 may be implemented with a single control signal.

Figure 5:
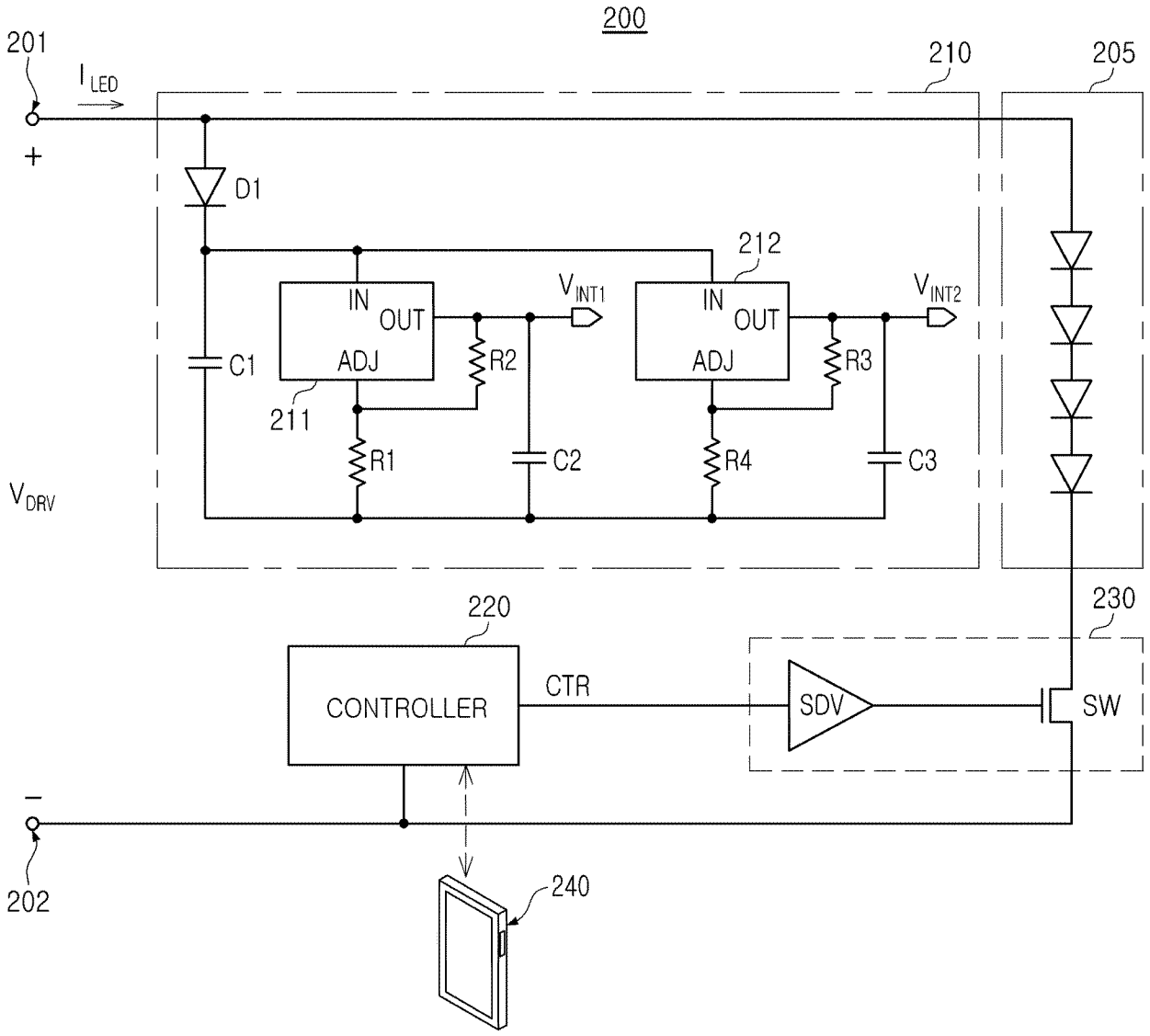
FIG. 5 is a block diagram illustrating an LED control device and a light source, according to an embodiment.

FIG. 5 is a block diagram illustrating an LED control device and a light source, according to an embodiment.

Referring to FIG. 5, the LED control device 200 in an embodiment may include a power supply 210, a controller 220 and a switching device 230, and may be connected to an external LED driver through a first driving node 201 and a second driving node 202. The LED control device 200 may be the same as the LED control device 40 shown in FIG. 1 or the LED control device 100 shown in FIG. 2. In the embodiment illustrated in FIG. 5, the configurations of the light source 205 and the switching device 230 may be similar to the example described with reference to FIG. 3 or FIG. 4.

For example, a light source 205 may include at least one LED string. The switching device 230 may include a switch SW and a switch driver SDV, connected to the LED string. The switch driver SDV may control the switch SW to turn on/off in response to a control signal CTR received from the controller 220, and brightness of the light source 205 may be controlled according to a duty ratio of the control signal CTR.

The power supply 210 may include a first regulator 211 and a second regulator 212. Each of the first regulator 211 and the second regulator 212 may include an input terminal IN and an output terminal OUT, and a resistor terminal ADJ connected to resistors. For, a magnitude of each of first and second internal power voltages $V_{INT1}$ and $V_{INT2}$ output to the output terminal OUT may vary depending on a resistor value connected to the resistor terminal ADJ.

The input terminal IN of each of the first regulator 211 and the second regulator 212 may be connected to a node between a first diode D1 and a first capacitor C1, and the first diode D1 may be connected to the first driving node 201. Accordingly, driving power $V_{DRV}$ may be input through the input terminal IN. The output terminal OUT of each of the first regulator 211 and the second regulator 212 may be connected to a second capacitor C2 or a third capacitor C3 functioning as an output capacitor.

In the first regulator 211, a first resistor R1 and a second resistor R2 may be connected to the output terminal OUT. A node between the first resistor R1 and the second resistor R2 may be connected to the resistor terminal ADJ of the first regulator 211, and a magnitude of the first internal power voltage $V_{INT1}$ may be determined depending on a resistor value of each of the first resistor R1 and the second resistor R2. Similarly, a magnitude of the second internal power voltage $V_{INT2}$ may be determined depending on a resistor value of each of a third resistor R3 and a fourth resistor R4.

In an embodiment, the first internal power voltage $V_{INT1}$ may be a power voltage necessary for operation of the controller 220, and the second internal power voltage $V_{INT2}$ may be a power voltage necessary for operation of the switching device 230. For, the magnitude of the first internal power voltage $V_{INT1}$ may be smaller than the second internal power voltage $V_{INT2}$. However, an embodiment thereof is not limited thereto, and the magnitude of each of the first internal power voltage $V_{INT1}$ and the second internal power voltage $V_{INT2}$ may vary depending on the embodiments.

The controller 220 may generate a control signal CTR as a PWM signal, and may output the control signal CTR to a switch driver SDV. The controller 220 may be connected to an external controller 240 through various wired/wireless communication methods. For, the external controller 240 may be a mobile device such as a smartphone or a tablet PC, or a lighting controller installed and fixed in a space adjacent to the LED control device 200.

As an, the controller 220 may recognize a voice command of a user through the external controller 240, and may generate a control signal CTR according to the command. In this case, the external controller 240 may be implemented as an AI speaker rather than a mobile device or a lighting controller. When the user transmits a command by voice using a voice recognition function of the AI speaker, the controller 220 may generate a control signal CTR in response to the command, and may turn on/off the light source 205 or may adjust brightness of the light source 205.

A user may monitor a state of the light source 205 included in the LED device 200 through the external controller 240 and also a state of the LED driver supplying the driving power $V_{DRV}$ to the LED control device 200. For, when a failure occurs in at least one of LEDs included in the light source 205, a voltage applied to the entire light source 205 may become different. The LED control device 200 may monitor the voltage and/or current output from the LED driver, thereby monitoring whether the LEDs are broken and also power consumption.

The power consumption of the LED driver supplying the driving power $V_{DRV}$ to the light source 205 may be determined by a maximum value of a rated voltage and a rated current of the LED driver, and may be defined by specification of the LED driver. When a forward voltage of the LEDs included in the light source 205 is similar to a minimum voltage of a rated voltage range of the LED driver, there may be a difference between the power consumption described in the specification of the LED driver and the power actually consumed by the light source 205. In an embodiment, by further including a voltage/current detection circuit connected to the light source 205, the controller 220 may calculate the actual power consumption of the light source 205, and may transmit the actual power consumption to the external controller 240, and may notify a user of the consumption.

Also, the LED control device 200 in an embodiment may determine whether flicker occurs in the light source 205. As described above, the LED control device 200 may include a voltage/current detection circuit which may detect a voltage and a current of the light source 205, and may transmit the voltage and the current to the controller 220. In this case, the controller 220 may determine whether flicker occurs using a ripple component of a sensing voltage detecting a driving current $I_{LED}$ input to the light source 205, and may transmit a result of the determination to the external controller 240. Alternatively, an optical sensor for detecting a light output from the light source 205 may be added to the LED control device 200, and the controller 220 may calculate an accurate flicker index. The flicker index may be determined to be a value between 0 and 1, and the more flickering, the higher the value may be. When it is determined that flicker occurs, the controller 220 may adjust a frequency of the control signal CTR, and may minimize flicker of the light source 205.

Figure 6:
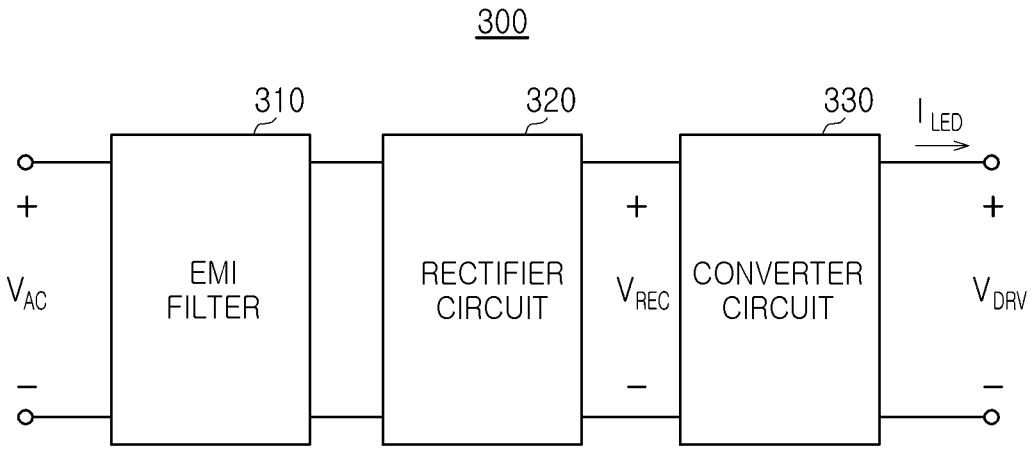
FIG. 6 is a block diagram illustrating an LED driver, according to an embodiment.

FIG. 6 is a block diagram illustrating an LED driver, according to an embodiment.

Referring to FIG. 6, an LED driver 300 in an embodiment may include an electromagnetic interference (EMI) filter 310, a rectifier circuit 320, and a converter circuit 330. The LED driver 300 may be the same as the LED driver, including the LED driver 20 of FIG. 1, described in the previous embodiments. The EMI filter 310 may receive AC power $V_{AC}$, and may filter electromagnetic waves included in the AC power $V_{AC}$. The rectifier circuit 320 may convert the AC power $V_{AC}$ filtered by the EMI filter 310 into DC power. In an embodiment, the rectifier circuit 320 may include a diode bridge.

The converter circuit 330 may supply driving power $V_{DRV}$ to a plurality of LEDs, and may be configured in various manners according embodiments. For, the converter circuit 330 may include a power factor correction (PFC) converter which may improve a power factor, and may increase a voltage, and a DC-DC converter. The converter circuit 330 may generate the driving power $V_{DRV}$ for driving a plurality of LEDs using the rectified power $V_{REC}$ generated by rectifying the AC power $V_{AC}$ by the rectifier circuit 320. A magnitude of a voltage of the driving power $V_{DRV}$ may be determined by characteristics of a plurality of LEDs connected to an output terminal of the converter circuit 330, a forward voltage of each of the LEDs, for example. In an embodiment, the LED driver 300 may output an LED current $I_{LED}$ for driving the LEDs as a constant current.

Figure 7:
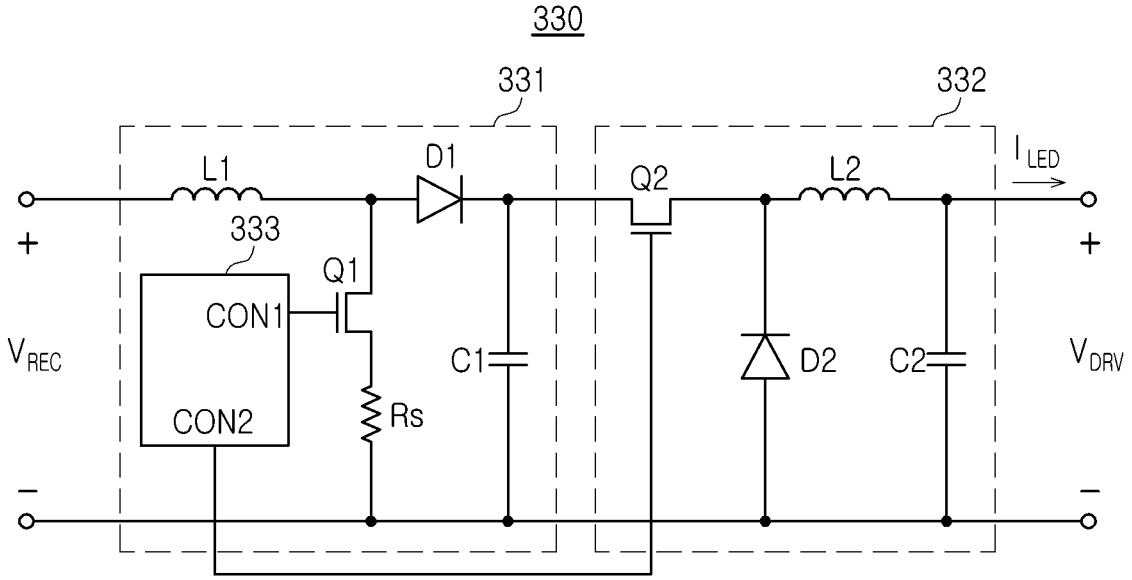
FIG. 7 is a circuit diagram illustrating a converter circuit included in an LED driver, according to an embodiment.

FIG. 7 is a circuit diagram illustrating a converter circuit included in an LED driver, according to an embodiment.

FIG. 7 shows a converter circuit 330 included in the LED driver 300 in the embodiment illustrated in FIG. 6. Referring to FIG. 7 along with FIG. 6, the converter circuit 330 may include a power factor correction (PFC) converter 331, a DC-DC converter 332, and a controller 333. The PFC converter 331 may operate as a boost converter circuit which may boost the rectified voltage $V_{REC}$ output from the rectifier circuit 320 shown in FIG. 6, and may include a first inductor L1, a first diode D1, a first capacitor C1, and a first converter switch Q1.

When the first converter switch Q1 is turned on by the controller 333, a current by the rectified power $V_{REC}$ may flow to a switch resistor $R_S$, and energy may be charged in the first inductor L1. When the controller 333 turns the first converter switch Q1 off, the current charged in the first inductor L1 may be discharged, and a voltage greater than the rectified voltage $V_{REC}$ input to the PFC converter 331 may be generated. In this case, a high frequency component may be removed by the first capacitor C1 connected to the first diode D1.

The DC-DC converter 332 connected in series with the PFC converter 331 may operate as a buck converter circuit, and may include a second inductor L2, a second diode D2, a second capacitor C2, and a first converter switch Q2. Similarly to the first converter switch Q1, the second converter switch Q2 may be controlled by the controller 333.

When the controller 331 turns the second converter switch Q2 on, a current may flow to the second inductor L2, and energy may be charged in the second inductor L2. When the controller 331 turns the second converter switch Q2 off, a current may flow by the energy charged in the second inductor L2, and the driving power $V_{DRV}$ may be output. The second diode D2 may provide a path through which a current may flow when the second converter switch Q2 is turned off, and the second capacitor C2 may function as a rectifying capacitor.

The LED current $I_{LED}$ output from the LED driver 300 to a plurality of LEDs include in a light source may have a fixed value. Also, the LED driver 300 may have a rated voltage within a predetermined rated range, and power consumption of the LED driver 300 may be determined by a maximum value of the rated voltage and the LED current $I_{LED}$. The LED current $I_{LED}$, the rated voltage, and the power consumption of the LED driver 300 may be provided as specifications of the LED driver 300.

However, when a sum of forward voltages of the plurality of LEDs falls below an intermediate voltage within the a rated voltage range for reasons such as a failure in which at least a portion of the plurality of LEDs connected to the LED driver 300 is broken, power consumption of the plurality of LEDs connected to the LED driver 300 as a load may be reduced. Accordingly, there may be a difference between the power consumption described in the specifications of the LED driver 300 and power actually consumed by the LED driver 300 in operation.

In an embodiment, the above issue may be addressed using an LED control device connected between a light source including a plurality of LEDs and the LED driver 300. The LED control device may monitor actual power consumption of the LED driver 300 by detecting a voltage applied to the plurality of LEDs and a current flowing in the plurality of LEDs. As an, when the plurality of LEDs provide a plurality of LED strings, and it is detected that a relatively small voltage is applied to one of the LED strings, it may be determined that a portion of the LEDs included in the corresponding LED strings may have failed. Accordingly, the power consumption of the LED driver 300 and also a state of the LED strings connected to the LED driver 300 may be monitored.

Figure 8:
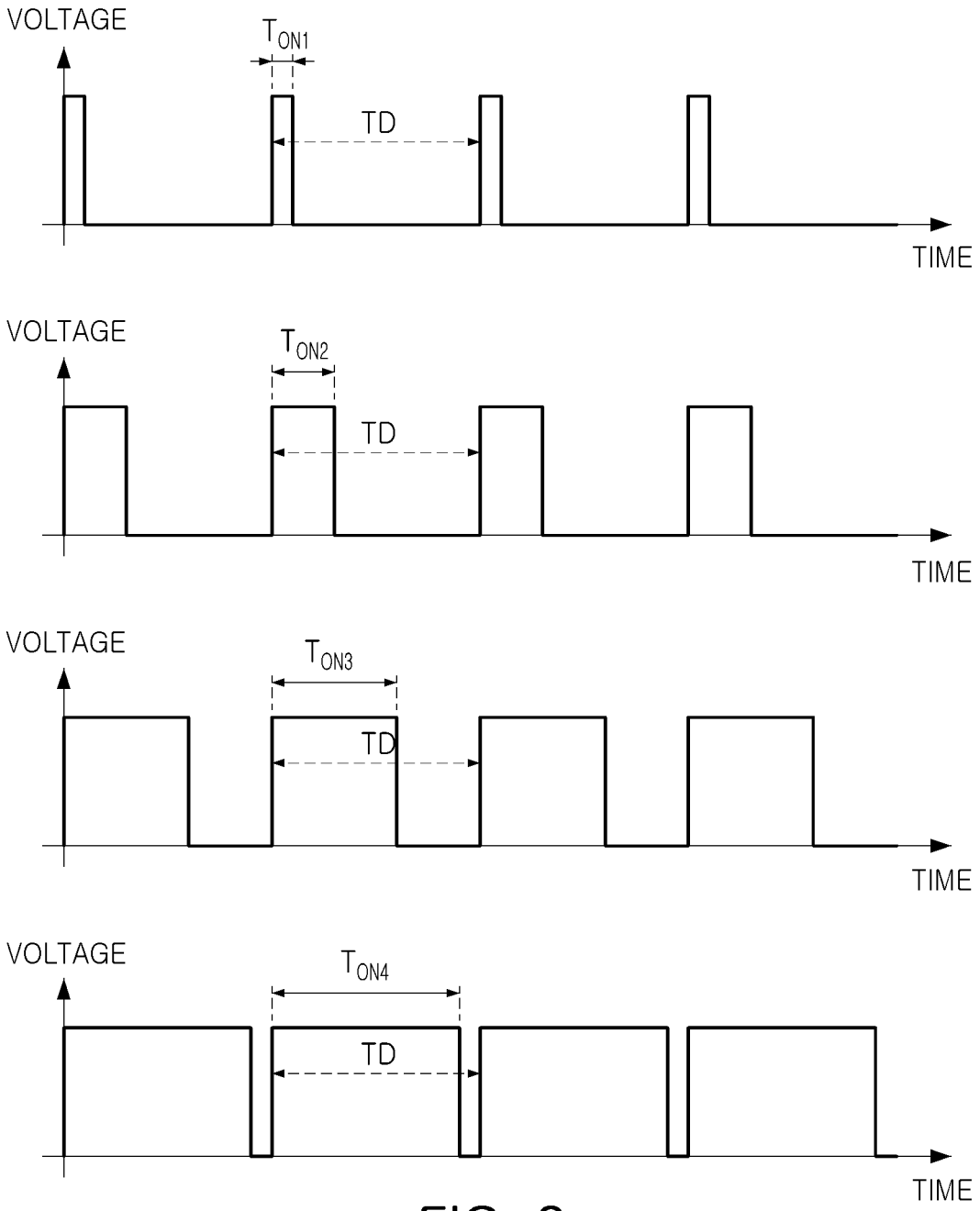
FIG. 8 illustrates graphs related to a dimming function of an LED control device, according to an embodiment.

FIG. 8 illustrates graphs related to a dimming function of an LED control device, according to an embodiment.

FIG. 8 shows waveforms of a control signal output to a switching device by a controller of an LED control device. In the description below, the operation of the LED control device 200 will be described with reference to FIGS. 1, 2, 5 and 6.

Referring to a first graph in FIG. 8, a control signal CTR may have a duty ratio of 10%. Accordingly, a turn-on time $T_{ON1}$ of the control signal CTR may be 10% of a period TD of the control signal CTR. In a second graph in FIG. 8, the control signal CTR may have a duty ratio of 30%, and in a third graph, the duty ratio of the control signal CTR may be 60%. In a fourth graph in FIG. 8, the control signal CTR may have a duty ratio of 90%.

The driving current $I_{LED}$ output from the LED driver 300 may be supplied to the light source 205 only at the turn-on time $T_{ON1}$, $T_{ON2}$, $T_{ON3}$, and $T_{ON4}$ of the control signal CTR. As the duty ratio of the control signal CTR increases, brightness of the light source 205 may increase, and as the duty ratio decreases, brightness of the light source 205 may decrease. For, when the duty ratio of the control signal CTR is 30%, only 30% of a rated current may be supplied to the light source 205.

As described with reference to FIG. 8, when brightness of the light source 205 is adjusted using the duty ratio of the control signal CTR, flicker may occur in the light source 205. In an embodiment, when flicker occurs in the light source 205, flicker of the light source 205 may be reduced by increasing or decreasing a frequency of the control signal CTR.

Figure 9:
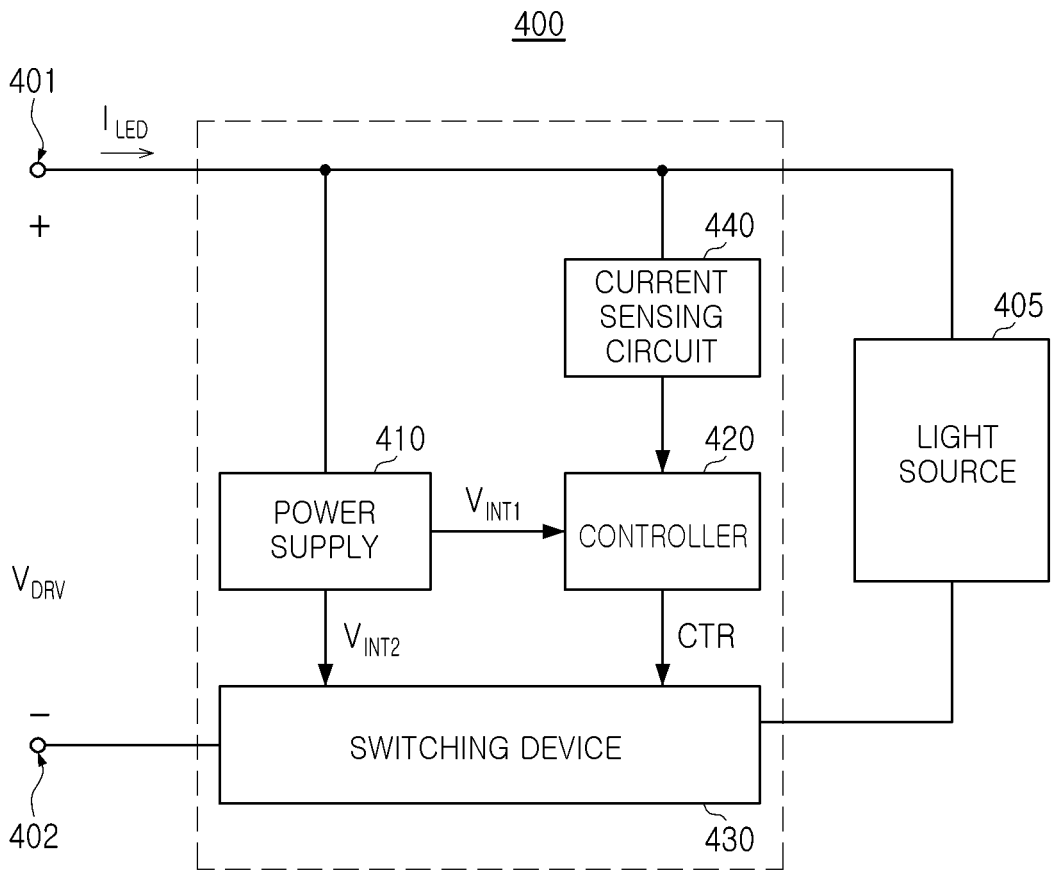
FIG. 9 is a block diagram illustrating an LED control device and a light source, according to an embodiment.

FIG. 9 is a block diagram illustrating an LED control device and a light source, according to an embodiment.

Referring to FIG. 9, an LED control device 400 in an embodiment may be connected to a first driving node 401 and a second driving node 402, and may be connected to a light source 405. The LED control device 400 may include a power supply 410, a controller 420, a switching device 430, and a current sensing circuit 440. Operations of the power supply 410, the controller 420, and the switching device 430 may be similar to the corresponding elements of the LED control device described in the previous embodiments.

In the embodiment illustrated in FIG. 9, the LED control device 400 may determine whether flicker occurs in the light source 405 using the current sensing circuit 440. When it is determined that flicker occurs in the light source 405, the controller 420 may increase or decrease a frequency of a control signal CTR. Accordingly, an operating frequency of a switch included in the switching device 430 and connected to the second driving node 402 may increase or decrease.

As an example, the current sensing circuit 440 may be connected to the first driving node 401, and may detect a driving current $I_{LED}$ input to the light source 405 through the first driving node 401 to generate a sensing voltage. The controller 420 may determine whether flicker occurs in the light source 405 by comparing an amount of fluctuation of the sensing voltage with a reference value. In an embodiment, the controller 420 may compare a difference between a maximum value and a minimum value of the sensing voltage for a predetermined period of time with the reference value, and when the difference between the maximum value and the minimum value is greater than the reference value, the controller 420 may determine that flicker occurs in the light source 405.

When it is determined that flicker occurs in the light source 405, the controller 420 may increase or decrease the frequency of the control signal CTR. Thereafter, while the switching device 430 operates with the control signal CTR at the changed frequency, the controller 420 may compare an amount of fluctuation of the sensing voltage with the reference value again. When the amount of fluctuation of the sensing voltage is less than the reference value, the control signal CTR at the changed frequency may be continuously output to the switching device 430, and when the amount of fluctuation of the sensing voltage is greater than the reference value, the controller 420 may change the frequency of the control signal CTR.

In the description below, operation of the LED control device 400 will be described in greater detail with reference to FIGS. 10 to 12.

Figure 10:
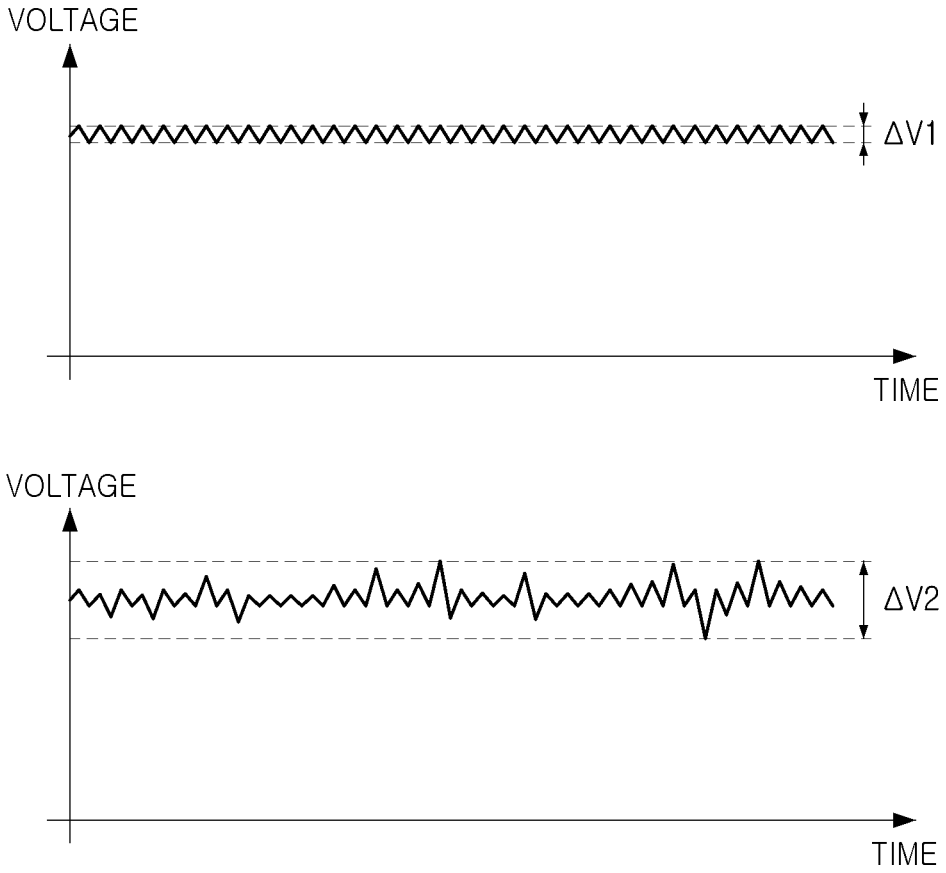
FIGS. 10 to 12 illustrate graphs related to an operation of an LED control device in reference to FIG. 9, according to embodiments.
Figure 11:
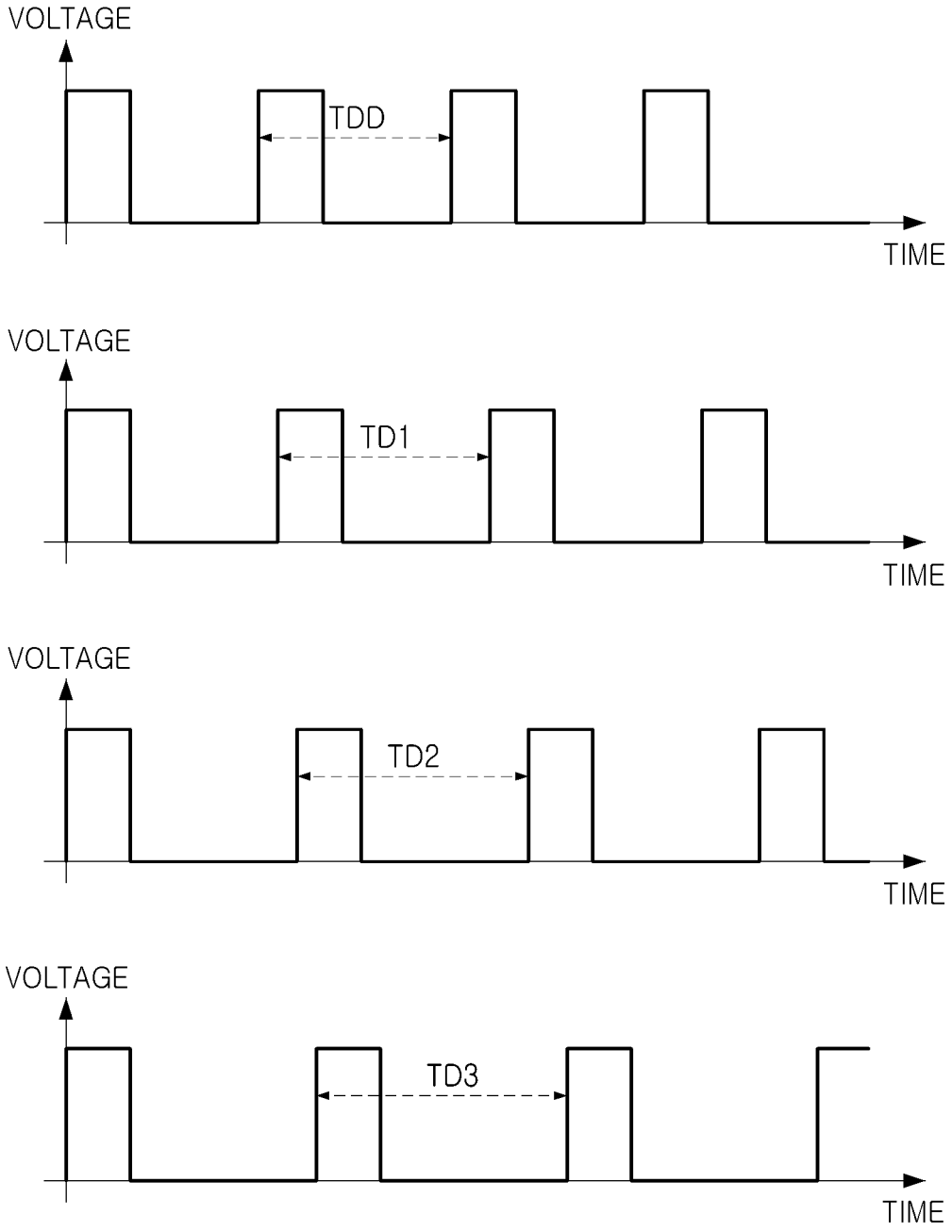
Figure 12:
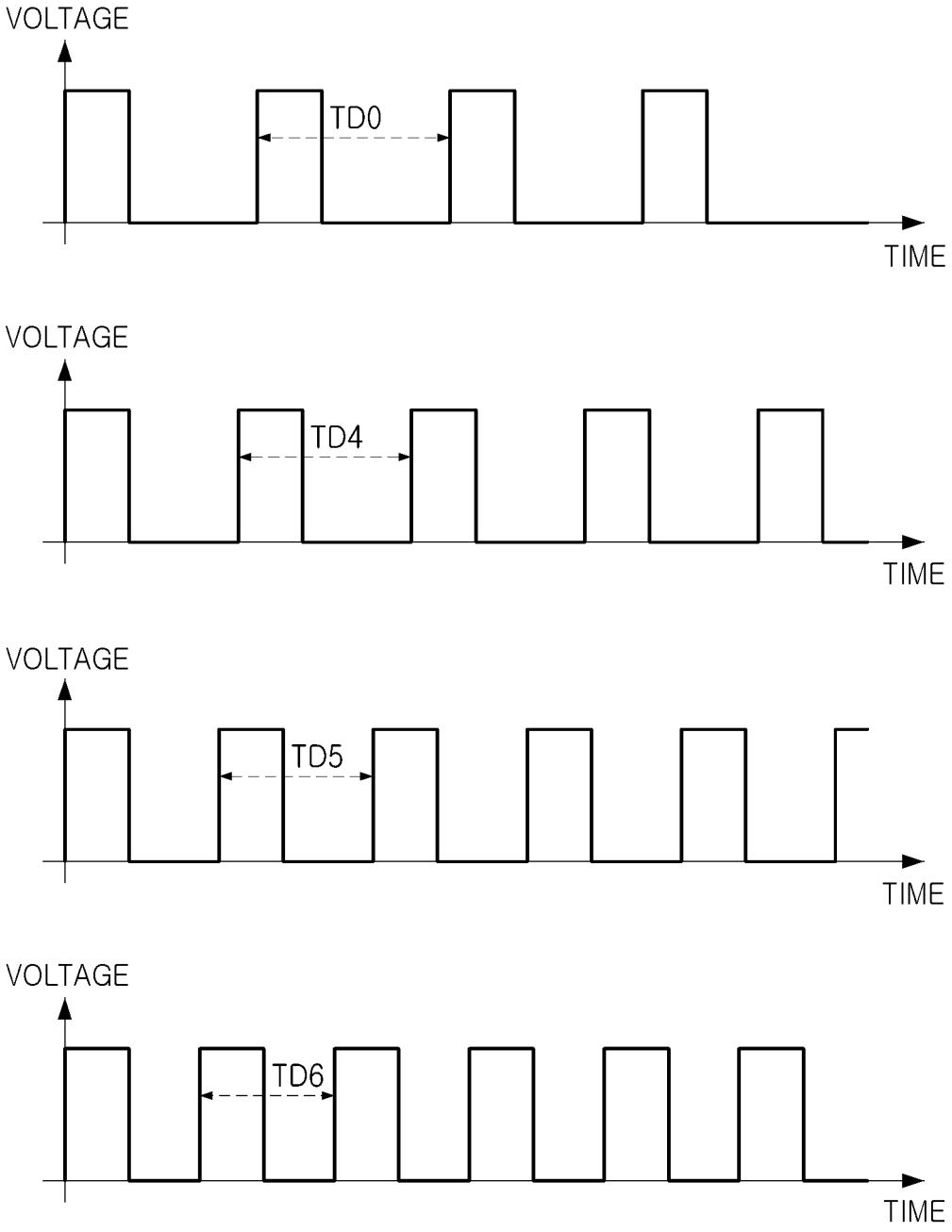

FIGS. 10 to 12 illustrate graphs related to an operation of an LED control device in reference to FIG. 9, according to embodiments.

FIG. 10 shows a method for the controller 420 to determine whether flicker occurs using a sensing voltage detected by the current sensing circuit 440. A first graph in FIG. 10 illustrates a sensing voltage detected by the current sensing circuit 440 when flicker does not occur in the light source 405. In the first graph in FIG. 10, the sensing voltage may increase or decrease within a first amount of fluctuation ΔV1 for a predetermined period of time.

The first amount of fluctuation ΔV1 may be smaller than a reference value for determining whether flicker occurs by the controller 420. In this case, although flicker does not occur in the light source 405 or flicker actually occurs in the light source 405, flicker may not be recognized by the human eye. Accordingly, in an embodiment based on the first graph in FIG. 10, the controller 420 may determine that flicker does not occur in the light source 405.

As an example, the reference value may be determined in proportion to the magnitude of the sensing voltage. For, the controller 420 may determine the reference value by multiplying an intermediate value of the sensing voltage by a predetermined coefficient. Accordingly, a reference value may be determined to be an optimal voltage for determining whether flicker occurs in consideration of the magnitude of the driving current $I_{LEA}$ and a load of the light source 405.

A second graph in FIG. 10 illustrates a sensing voltage detected by the current sensing circuit 440 when flicker occurs in the light source 405. In the second graph in FIG. 10, the sensing voltage may increase and decrease within a second amount of fluctuation ΔV2 larger than the first amount of fluctuation ΔV1 for a predetermined period of time. The second amount of fluctuation ΔV2 may be greater than a reference value at which the controller 420 determines whether flicker occurs. Accordingly, in the embodiment based on the second graph in FIG. 10, the controller 420 may determine that flicker occurs in the light source 405.

When it is determined that flicker occurs in the light source 405, the controller 420 may adjust the frequency of the control signal CTR such that the amount of fluctuation of the sensing voltage may be reduced. For, referring to FIG. 11, the controller 420 may reduce the frequency of the control signal CTR.

In the embodiment illustrated in FIG. 11, the duty ratio of the control signal CTR output from the controller 420 may be 30%. The controller 420 may increase a period of the control signal CTR from an initial period TD0 to a first period TD1. While the control signal CTR has the first period TD1, the controller 420 may compare the amount of fluctuation of the sensing voltage with a reference value. When the amount of fluctuation of the sensing voltage is less than or equal to the reference value, the controller 420 may maintain the period of the control signal CTR to be the first period TD1. When the amount of fluctuation of the sensing voltage exceeds the reference value, the controller 420 may further increase the period of the control signal CTR to the second period TD2. When the amount of fluctuation of the sensing voltage exceeds the reference value while the control signal CTR has the second period TD2, the controller 420 may increase the period of the control signal CTR to the third period TD3. As described above, the controller 420 may compare the amount of fluctuation of the sensing voltage output from the current sensing circuit 440 with the reference value while reducing the frequency of the control signal CTR, and the control signal CTR may be output at the frequency at which flicker does not occur or flicker is minimized.

Referring to FIG. 12, the controller 420 may increase the frequency of the control signal CTR to suppress flicker. As described above with reference to FIG. 11, in the embodiment illustrated in FIG. 12, the duty ratio of the control signal CTR output from the controller 420 may be 30%.

The controller 420 may reduce the period of the control signal CTR from the initial period TD0 to the fourth period TD4. While the control signal CTR has a fourth period TD4, the controller 420 may compare the amount of fluctuation of the sensing voltage with a reference value, and when the amount of fluctuation of the sensing voltage is less than the reference value, the controller 420 may maintain the period of the control signal CTR to be the fourth period TD4. When the amount of fluctuation of the sensing voltage exceeds the reference value, the controller 420 may further reduce the period of the control signal CTR to the fifth period TD5. When the amount of fluctuation of the sensing voltage exceeds the reference value while the control signal CTR has the fifth period TD5, the controller 420 may reduce the period of the control signal CTR back to the sixth period TD6. As described above, the controller 420 may compare the amount of fluctuation of the sensing voltage output from the current sensing circuit 440 with a reference value while increasing the frequency of the control signal CTR, and the frequency of the control signal CTR at which no flicker occurs or flicker is minimized.

Operations in the embodiments described with reference to FIGS. 11 and 12 may be sequentially executed. For example, the controller 420 may find an optimum frequency for the control signal CTR while increasing or decreasing the frequency of the control signal CTR. When flicker is not suppressed in the operation of increasing the frequency of the control signal CTR, the controller 420 may determine whether flicker occurs while decreasing the frequency of the control signal CTR. In an embodiment, when flicker is not completely suppressed by adjusting the frequency of the control signal CTR, the controller 420 may generate the control signal CTR at a frequency corresponding to a frequency at which the amount of fluctuation of the sensing voltage is smallest.

Figure 13:
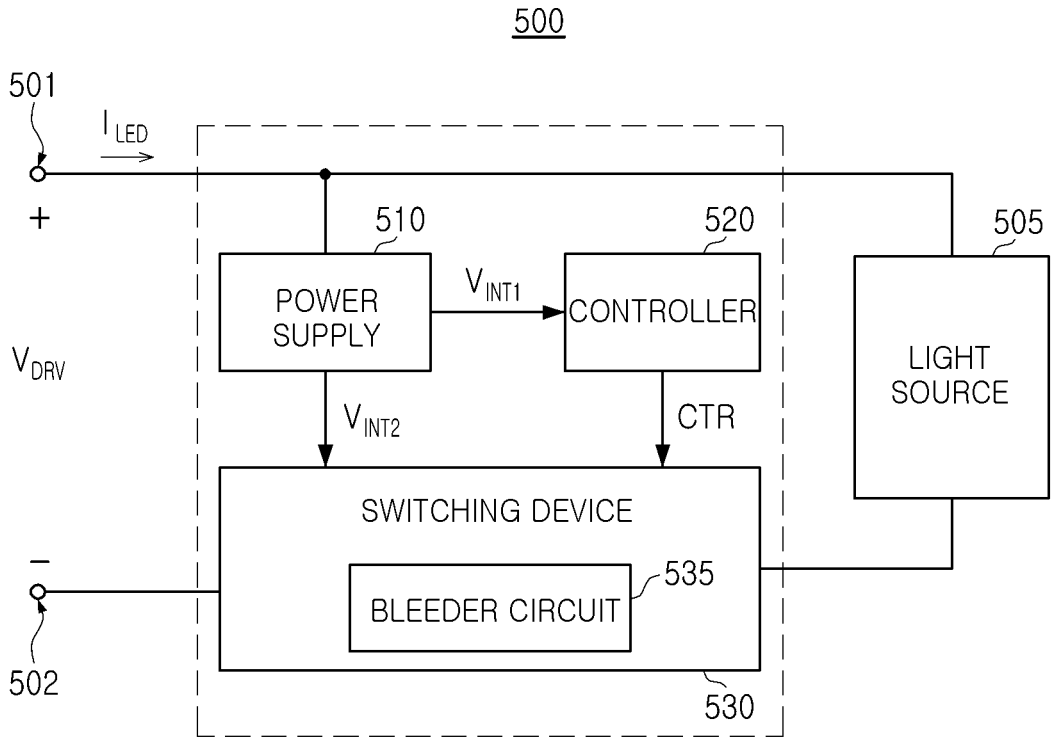
FIG. 13 is a block diagram illustrating an LED control device and a light source, according to an embodiment.

FIG. 13 is a block diagram illustrating an LED control device and a light source, according to an embodiment.

Referring to FIG. 13, an LED control device 500 in an embodiment may be connected to a first driving node 501 and a second driving node 502, and may be connected to a light source 505. The LED control device 500 may include a power supply 510, a controller 520 and a switching device 530, and the switching device 530 may include a bleeder circuit 535.

The power supply 510 may supply a first internal power voltage $V_{INT2}$ to the controller 520 using driving power $V_{DRV}$, and may supply a second internal power voltage $V_{INT2}$ to the switching device 530. The controller 520 may generate a control signal CTR, and may transmit the control signal CTR to the switching device 530, and the switching device 530 may control the light source 505 based on the control signal CTR.

As described above, the control signal CTR may be a PWM signal having a predetermined period and a duty ratio, and the control signal CTR may have a first level during a turn-on time, and may have a second level smaller than the first level during a turn-off time. For, the first level may be a level at which the switch included in the switching device 530 may be turned on, and the second level may be a level at which the switch is turned off. As described above, in an embodiment, the second level may be a ground voltage.

The turn-on time and the turn-off time of the control signal CTR is an extremely short time, and the driving current $I_{LED}$ output from the LED driver 300 (FIG. 6) during the turn-off time may not be supplied to the light source 505. However, since the turn-off time is extremely short, the LED driver 300 may not be completely shut down during the turn-off time, and accordingly, the drive current $I_{LED}$ greater than a rated current at the turn-on time after the turn-off time may be supplied to the light source 505.

In the embodiment, to address the above problem, the switching device 530 may include a bleeder circuit 535. The bleeder circuit 535 may function to maintain a predetermined load impedance even during the turn-off time. In other words, a current may flow to the light source 505 even during the turn-off time of the control signal CTR by the bleeder circuit 535. The current flowing to the light source 505 during the turn-off time may be smaller than the driving current $I_{LED}$ supplied to the light source 505 during the turn-on time. In the description below, an operation of the switching device 530 including the bleeder circuit 535 will be described in greater detail with reference to FIGS. 14 to 17.

Figure 14:
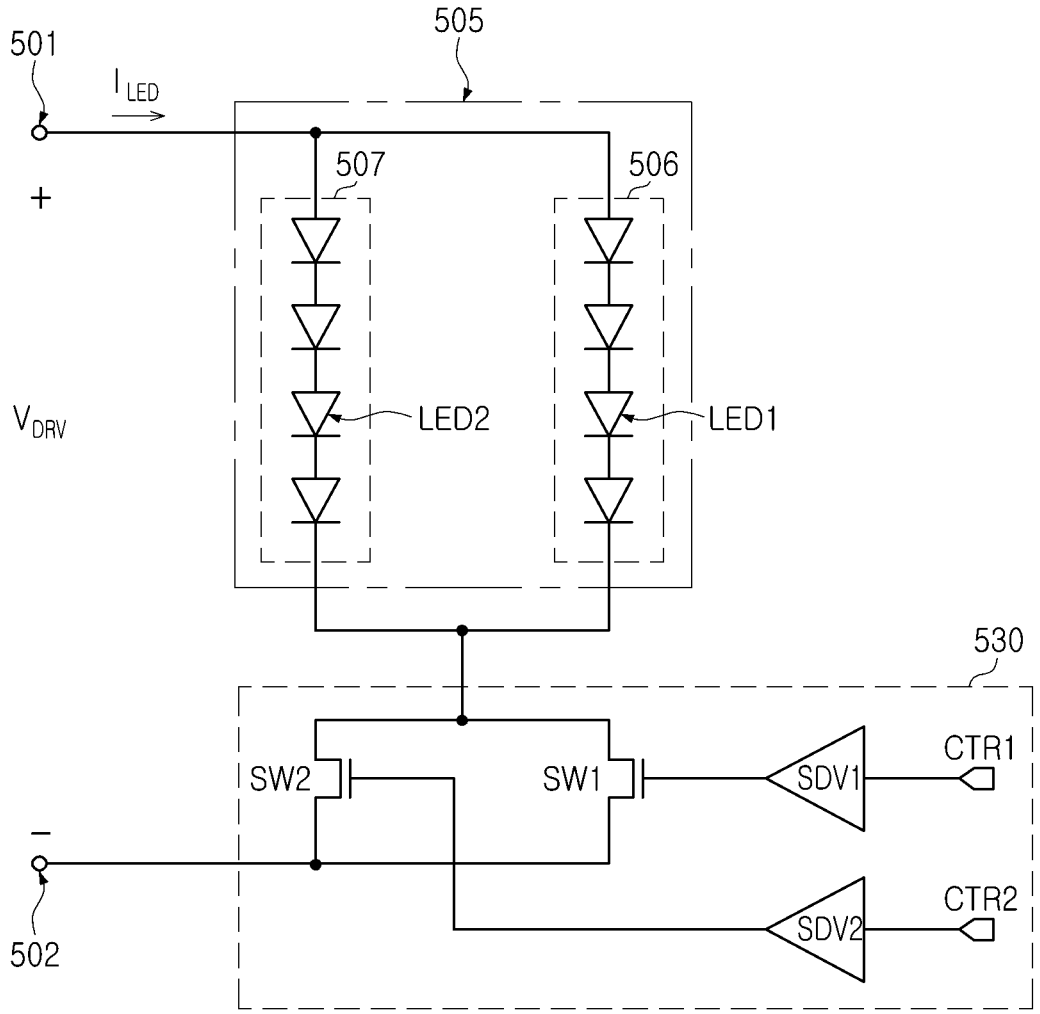
FIGS. 14 to 16 are circuit diagrams illustrating a switch included in an LED control device and a light source in reference to FIG. 13.
Figure 15:
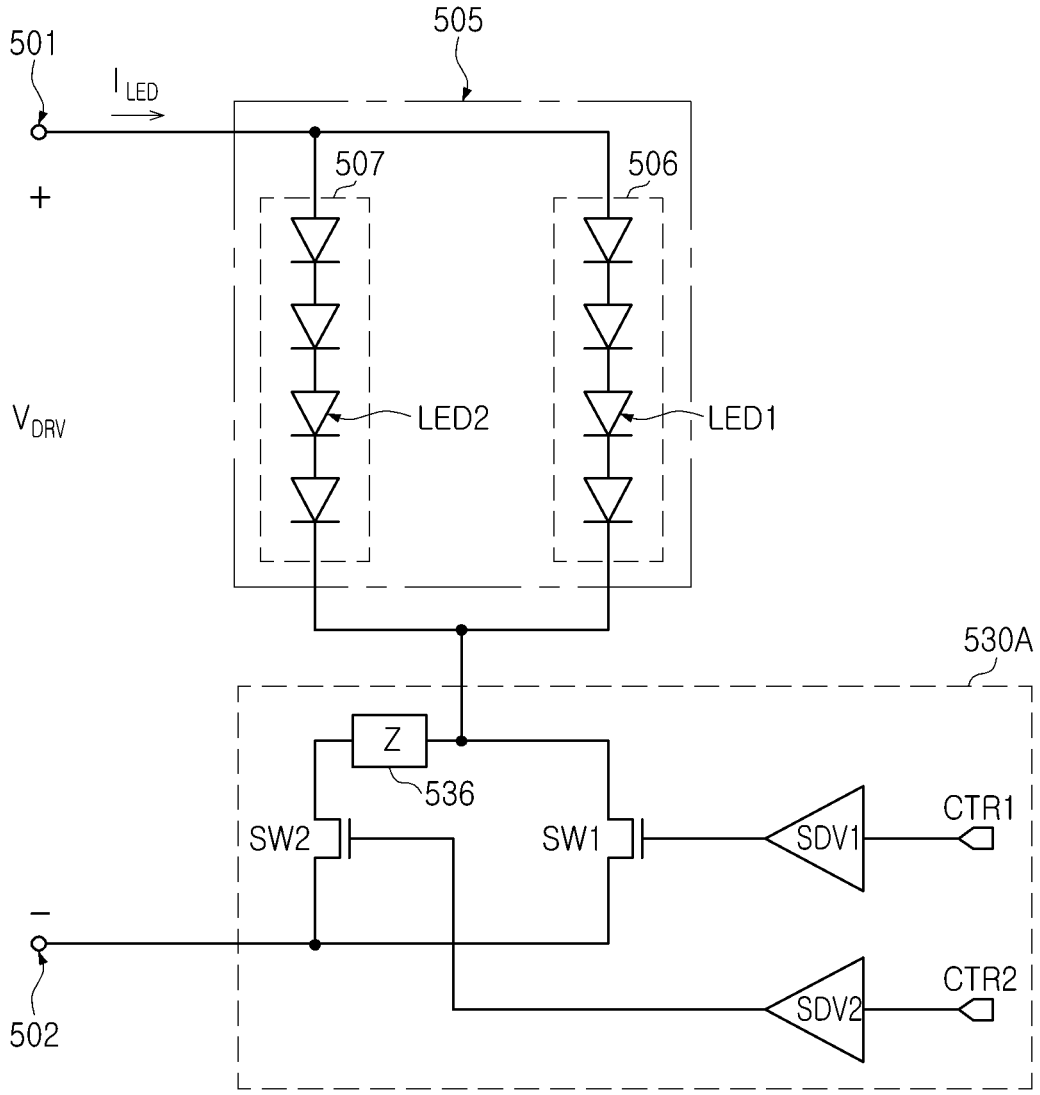
Figure 16:
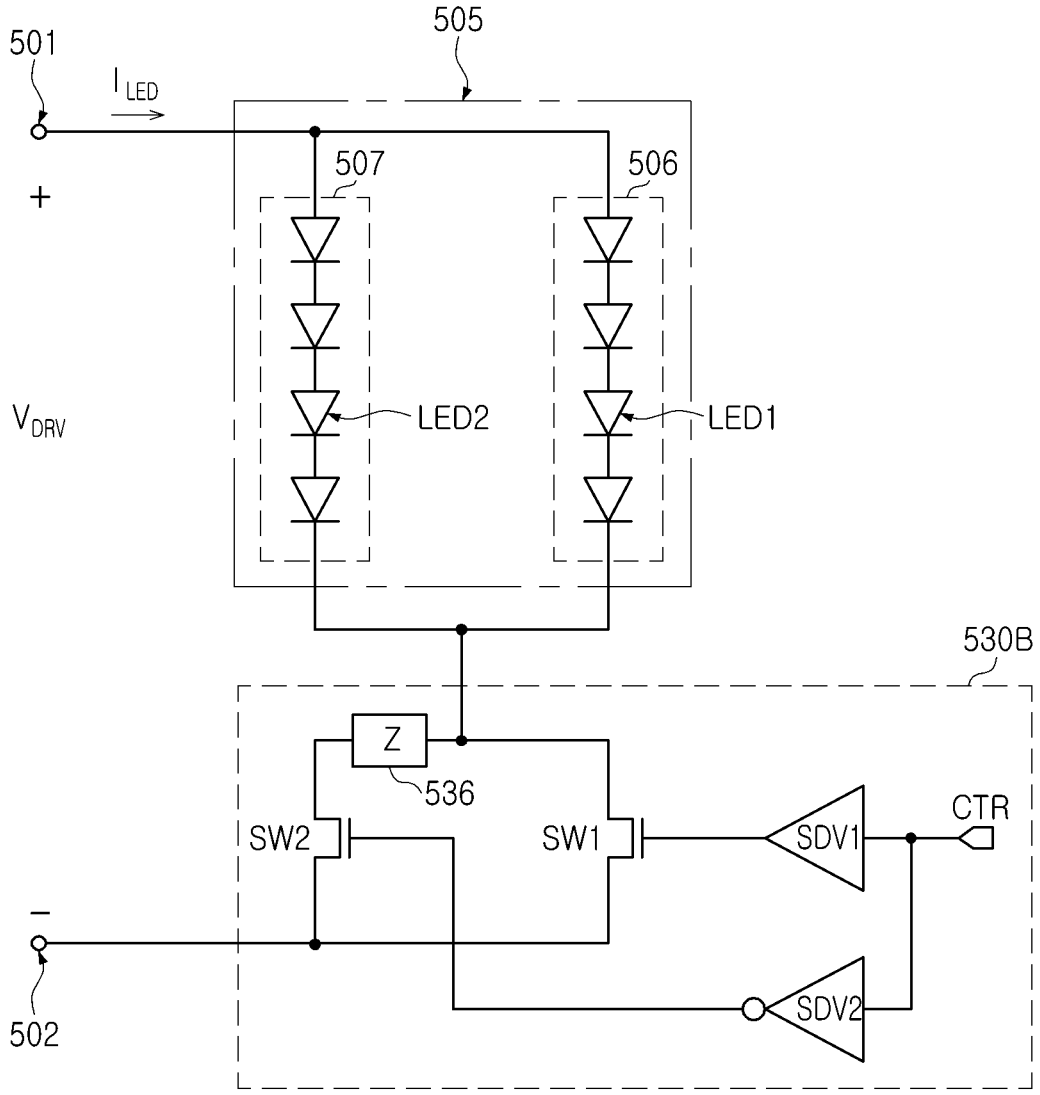
Figure 17:
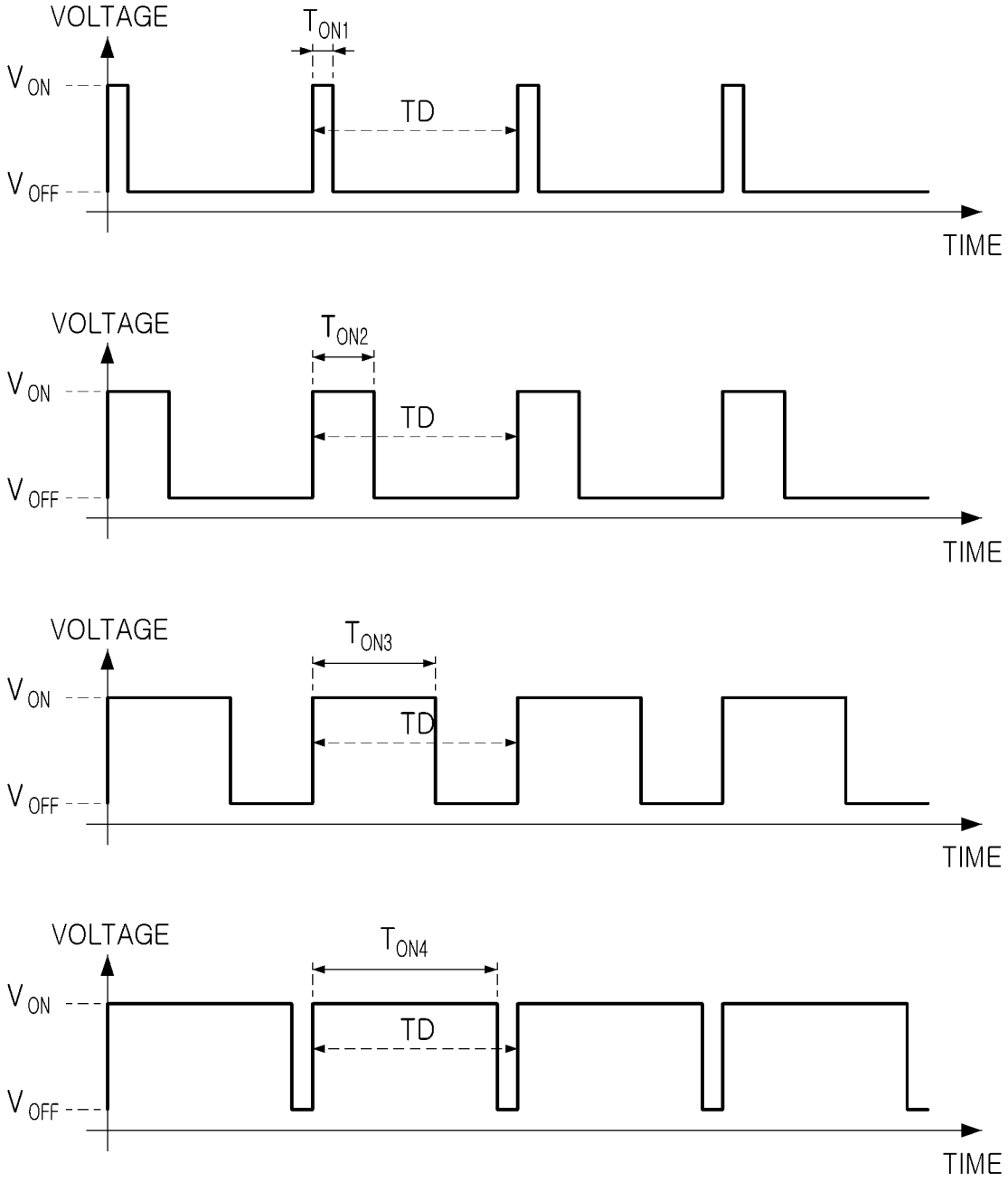
FIG. 17 illustrates graphs related to an operation of an LED control device shown in FIGS. 14 to 16, according to embodiments.

FIGS. 14 to 16 are circuit diagrams illustrating a switch included in an LED control device and a light source in reference to FIG. 13, and FIG. 17 illustrates graphs related to an operation of an LED control device shown in FIGS. 14 to 16, according to embodiments.

Operation of the switching device 530 will be described with reference to FIGS. 14 to 16. Referring to FIG. 14, the light source 505 may include a first LED string 506 having first LEDs LED1 and a second LED string 507 having second LEDs LED2, and may operate by the driving current $I_{LED}$ input to the driving node 501.

The switching device 530 may be connected between the light source 505 and the second driving node 502, and may include a first switch SW1, a second switch SW2, a first switch driver SDV1, and a second switch driver SDV2. The first switch SW1 and the second switch SW2 may be connected in parallel with each other, and may be connected to the first LED string 506 and the second LED string 507 in common. The first switch SW1 may be turned on/off by a first control signal CTR1, and the second switch SW2 may be turned on/off by a second control signal CTR2.

In the embodiment illustrated in FIG. 14, the first switch SW1 and the second switch SW2 may be alternately turned on. For example, the first switch SW1 may be turned on during a time when the light source 505 emits light, and the second switch SW2 may be turned on during a time when the light source 505 does not emit light. Accordingly, the second switch SW2 and the second switch driver SDV2 may form the bleeder circuit 535 described above with reference to FIG. 13.

In an embodiment, the second control signal CTR2 may be a complementary signal of the first control signal CTR1, and the first switch SW1 and the second switch SW2 may have different characteristics. As an example, the first turn-on current flowing through the first switch SW1 while the first switch SW1 is turned on may be greater than the second turn-on current flowing through the second switch SW2 while the second switch SW2 is turned on. Accordingly, the light source 505 may not actually emit light while the second switch SW2 is turned on.

Alternatively, the first switch SW1 and the second switch SW2 may have the same characteristics, and the first control signal CTR1 and the second control signal CTR2 may have different levels. For, a level of the first control signal CTR1 during the turn-on time of the first switch SW1 may be greater than the level of the second control signal CTR2 during the turn-on time of the second switch SW2. Accordingly, the second turn-on current may be smaller than the first turn-on current.

In the embodiment illustrated in FIG. 15, an impedance device 536 may be connected between the second switch SW2 and the light source 505. The impedance device 536 may include a high-power bleeder resistor and/or a bleeder inductor. Accordingly, while the second switch SW2 is turned on, the voltage applied to the light source 505 may be lowered. In the embodiment illustrated in FIG. 15, the bleeder circuit 535 may include the second switch SW2, the second switch driver SDV2, and the impedance device 536. Since the impedance device 536 is connected between the second switch SW2 and the light source 505, the second switch SW2 may have the same characteristics as those of the first switch SW1, and the second control signal CTR2 may be a complementary signal of the first control signal CTR1.

In the embodiment illustrated in FIG. 16, the first switch SW1 and the second switch SW2 may be controlled by a single control signal CTR. To control the first switch SW1 and the second switch SW2 using a single control signal CTR, the second switch driver SDV2 may control the second switch SW2 as a complementary signal of the control signal CTR. As described with reference to FIG. 15, in the embodiment illustrated in FIG. 16, the bleeder circuit 535 may include the second switch SW2, the second switch driver SDV2, and the impedance device 536.

FIG. 17 shows waveforms of a control signal CTR. Referring to FIG. 17, the control signal CTR may have a first level $V_{ON}$ during the turn-on time of the light source 505, and may have a second level $V_{OFF}$ during the turn-off time of the light source 505. The second level $V_{OFF}$ may be greater than the ground voltage.

In the embodiment illustrated in FIG. 17, the second switch SW2 included in the bleeder circuit 536 may be implemented as a device which may be turned off by a gate voltage of the first level $V_{ON}$, and may be turned on by a gate voltage of the second level $V_{OFF}$. A current path may be provided by the second switch SW2 turned on during the turn-off time of the light source 505 and the impedance device 536 connected to the second switch SW2, and a predetermined load impedance may be provided to an LED driver. Accordingly, in the turn-on time after the turn-off time of the light source 505, the driving current $I_{LED}$ may be prevented from increasing beyond a rated current and stability of a lighting device may improve.

Figure 18:
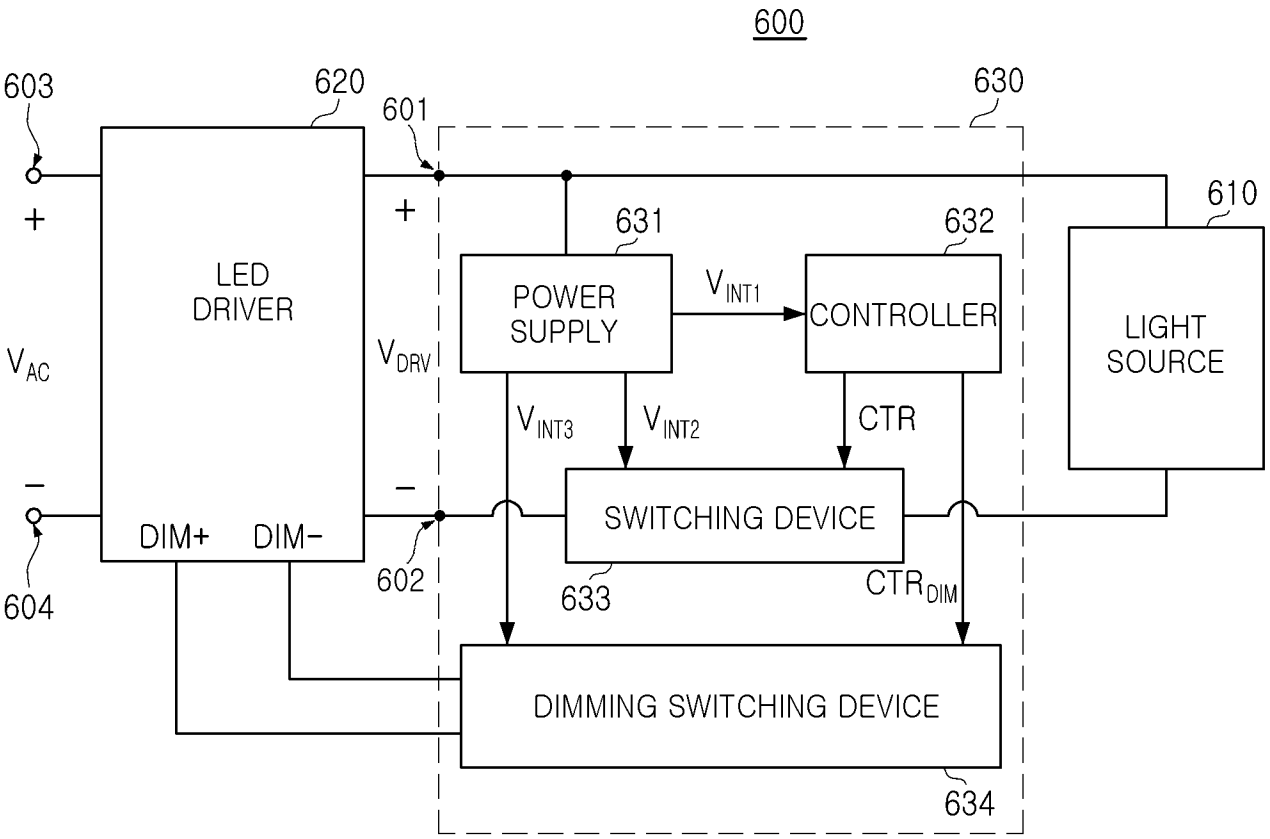
FIG. 18 is a block diagram illustrating a lighting device, according to an embodiment.

FIG. 18 is a block diagram illustrating a lighting device, according to an embodiment.

FIG. 18 shows a lighting device 600 providing a dimming function. Referring to FIG. 18, the lighting device 600 may include a light source 610, an LED driver 620, and an LED control device 630. The LED driver 620 may receive AC power $V_{AC}$, and may generate driving power $V_{DRV}$. The light source 610 may include at least one LED string, and the LED string may operate by driving power $V_{DRV}$. The light source 610 may be supplied with a driving current $I_{LED}$ through a first driving node 601, and the LED control device 630 may be connected to the first driving node 601 and a second driving node 602.

In the embodiment illustrated in FIG. 18, the LED control device 630 may include a power supply 631, a controller 632, a switching device 633, and a dimming switching device 634. The power supply 631 may output a first internal power voltage $V_{INT1}$, a second internal power voltage $V_{INT2}$, and a third internal power voltage $V_{INT3}$, and the controller 632 may operate at first internal power voltage $V_{INT1}$ and the switching device 633 may operate at the second internal power voltage $V_{INT2}$. The controller 632 may output a control signal CTR for controlling the switching device 633 and a dimming control signal $CTR_{DIM}$ for controlling the dimming switching device 634, and each of the control signal CTR and the dimming control signal $CTR_{DIM}$ may be a PWM signal. Specific operations of the power supply 631, the controller 632, and the switching device 633 may be understood with reference to other embodiments described above.

The dimming switching device 634 may operate at the third internal power voltage $V_{INT3}$, and may generate a dimming control voltage in response to the dimming control signal $CTR_{DIM}$. In the embodiment illustrated in FIG. 18, the LED driver 630 may provide a dimming function, and may thus include dimming control terminals DIM+ and DIM− as illustrated in FIG. 18. The dimming switching device 634 may output the dimming control voltage generated in response to the dimming control signal $CTR_{DIM}$ to the dimming control terminals DIM+ and DIM−.

As an, the dimming control signal $CTR_{DIM}$ may be a PWM signal, and the dimming switching device 634 may determine a magnitude of a dimming control voltage depending on a duty ratio of the dimming control signal $CTR_{DIM}$. For, when it is assumed that the dimming control voltage outputting the maximum brightness is 3V, and the duty ratio of the dimming control signal $CTR_{DIM}$ is 50%, the dimming control voltage may be 1.5V. Also, when the duty ratio of the dimming control signal $CTR_{DIM}$ is 30%, the dimming control voltage may be 0.9V, and when the duty ratio of the dimming control signal $CTR_{DIM}$ is 80%, the dimming control voltage may be 2.4V. The magnitude of the LED current $I_{LED}$ output from the LED driver 530 may change according to the magnitude of the dimming control voltage, and thus, brightness of light output from the light source 610 may be adjusted. In the embodiment illustrated in FIG. 18, since the dimming function is implemented by the dimming switching device 634, the duty ratio of the control signal CTR output from the controller 632 to the switching device 633 may be a constant value.

Figure 19:
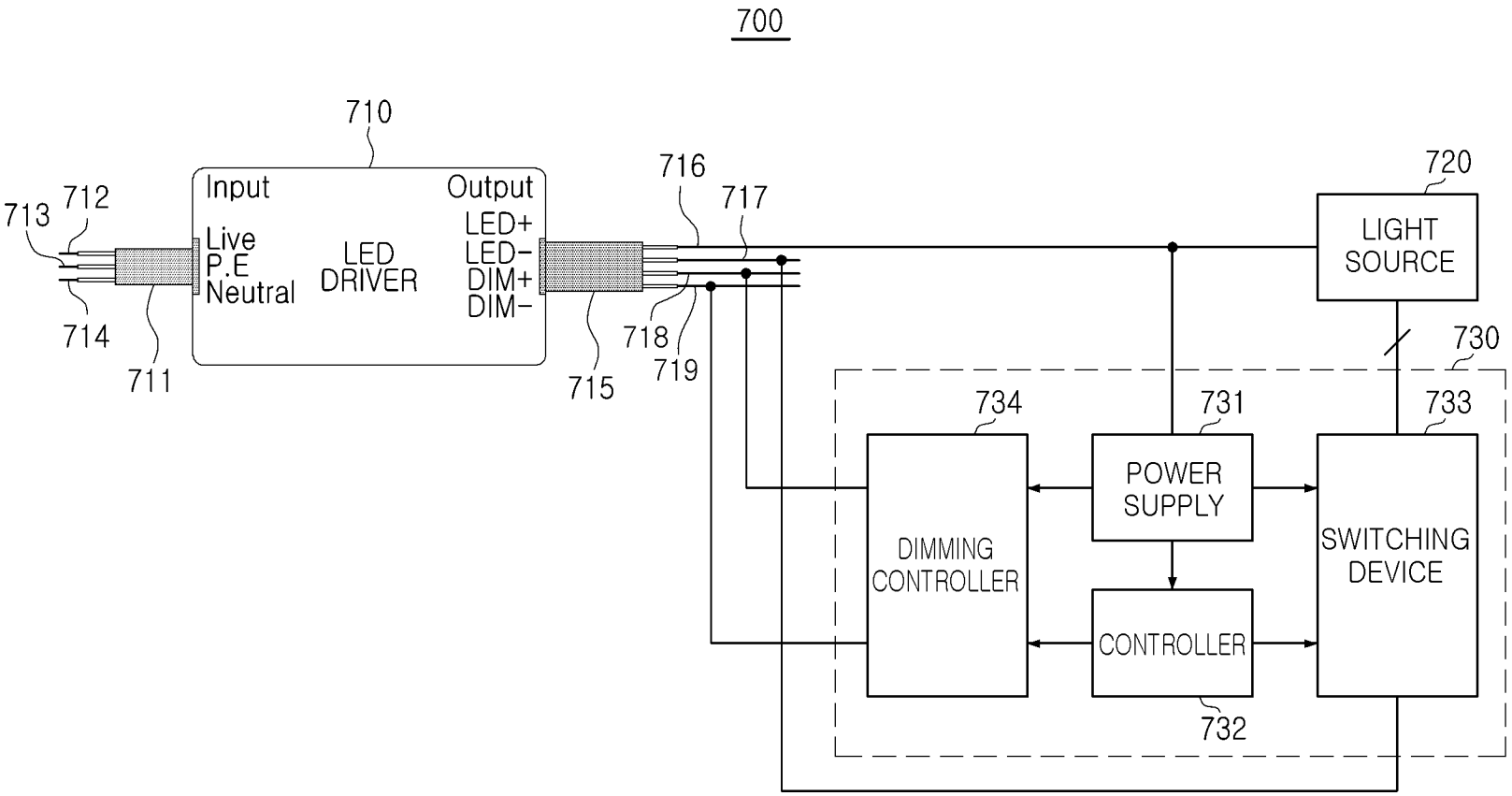
FIGS. 19 and 20 illustrates lighting devices, according to embodiments.
Figure 20:
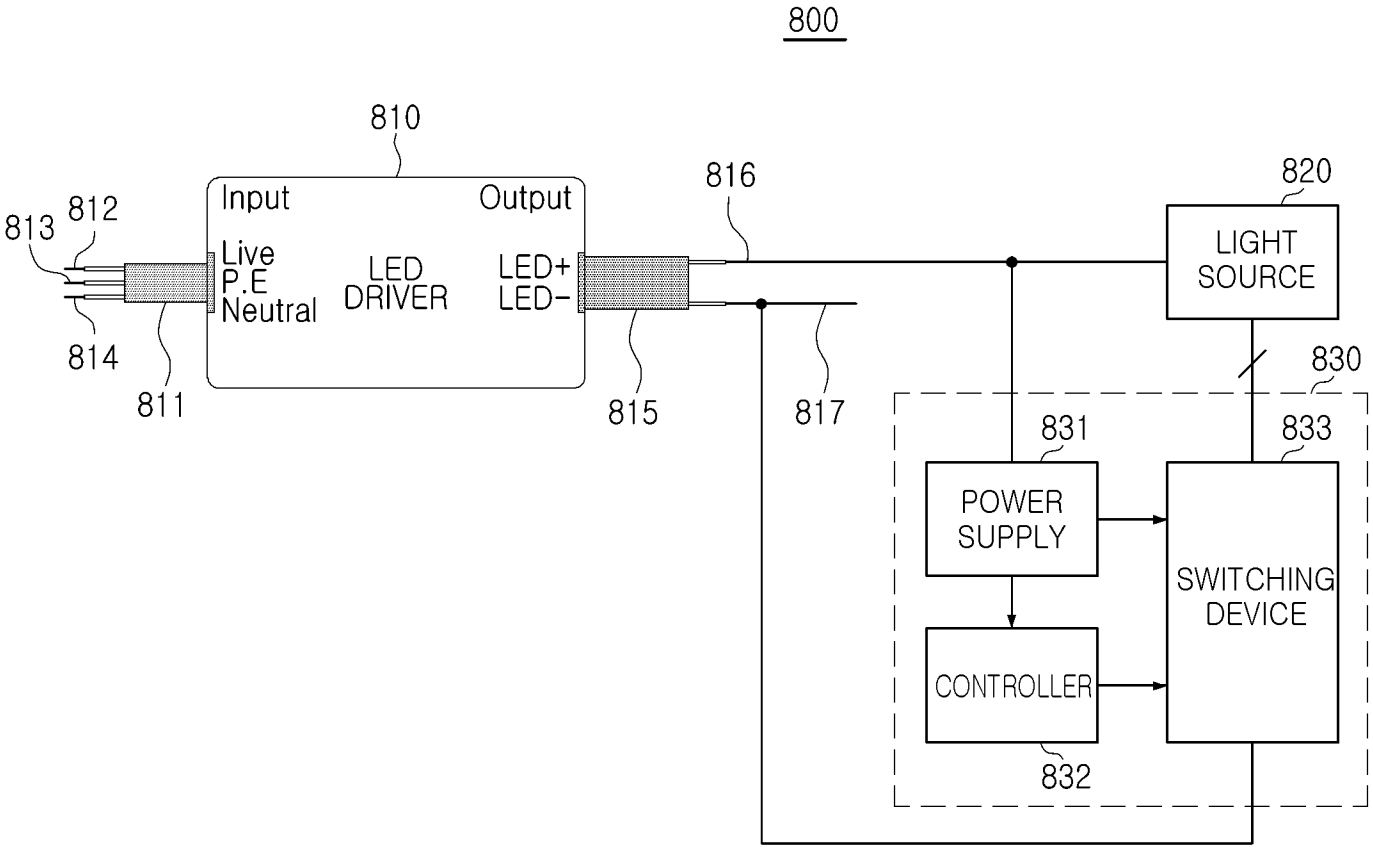

FIGS. 19 and 20 illustrates lighting devices, according to embodiments.

FIG. 19 shows an LED driver 710 providing a dimming function, a light source 720, and an LED control device 730. Referring to FIG. 19, the LED driver 710 may be connected to an input harness 711 and an output harness 715. The input harness 711 may include a plurality of input terminals 712-714 receiving AC power, and the output harness 715 may include a plurality of output terminals 716-719 for transmitting driving power generated by the LED driver 710 to the light source 720 including a plurality LEDs. Among the plurality of output terminals 716-719, the first output terminal 716 and the second output terminal 717 may be terminals for outputting the driving power. For, a voltage output to the first output terminal 716 may be greater than a voltage output to the second output terminal 717.

The LED driver 710 may generate the driving power using the AC power input through the input harness 712. The LED driver 710 may include an EMI filter, a rectifier circuit, a converter circuit, and a controller. The rectifier circuit may convert the AC power into DC power, and the converter circuit may generate the driving power using the DC power. Depending on an application field of the lighting device 700, the LED driver 710 may have waterproof and dustproof performance. In an embodiment, the LED driver 710 may be sealed with a sealing member for blocking permeation of moisture and dust.

In an embodiment, the LED driver 710 may output a constant current to drive the LEDs connected to the output harness 715, and a magnitude of the constant current may be determined by the controller of the LED driver 710. The controller may provide a dimming function for adjusting the magnitude of the constant current output from the LED driver 710 within a rated current range. The controller may adjust the magnitude of the constant current according to a dimming control signal input through the dimming terminals DIM+ and DIM− described above in reference to FIG. 18.

Referring to FIG. 19, the light source 720 and the LED control device 730 may be connected to the output harness 715. The LED control device 730 may include a power supply 731, a controller 732, a switching device 733, and a dimming controller 734. When the controller 732 receives a control command including a dimming command for changing brightness of light output from the light source 720 from an external controller through wired/wireless communication, the controller 731 may convert the dimming command to the dimming control signal, which is a PWM signal, and may transmit the dimming control signal to the dimming controller 734. The dimming controller 734 may determine a level of a dimming control voltage based on a duty ratio of the dimming control signal, and may output the dimming control voltage to the dimming control terminals DIM+ and DIM−. A magnitude of the constant current output from the LED driver 710 may increase or decrease depending on the magnitude of the dimming control voltage received through the dimming control terminals DIM+ and DIM−.

FIG. 20 shows a lighting device 800 including an LED driver 810 which does not provide a dimming function. Referring to FIG. 20, the LED driver 810 may include an input harness 811 and an output harness 815. The input harness 811 may include a plurality of input terminals 812-814 receiving AC power, and the output harness 815 may include a plurality of output terminals 816 and 817 for transmitting driving power generated by the LED driver to the LEDs. The output harness 815 may be connected to a light source 820 and an LED control device 830.

In the embodiment illustrated in FIG. 20, the LED driver 810 may not provide a dimming function, and accordingly, a dimming control terminal may not be provided in the LED driver 810. Accordingly, in the embodiment illustrated in FIG. 20, the dimming function may be implemented by the controller 832 and the switching device 833. For, the controller 832 may implement the dimming function by adjusting a duty ratio of a control signal for turning on/off a switch included in the switching device 833.

According to the aforementioned embodiments, by connecting an LED control device to driving nodes which may connect an LED driver and a light source, communication with an external controller and a dimming function may be implemented without exchanging or upgrading the LED driver included in an existing lighting device. Accordingly, the lighting device which is able to reduce waste of already installed devices and increase user convenience may be implemented.

At least one of the components, elements, modules or units (collectively "components" in this paragraph) represented by a block in the drawings may be embodied as various numbers of hardware, software and/or firmware structures that execute respective functions described above, according to an example embodiment. These components may include the LED driver 20, the power supply 110, the controller 120, the switch driver SDV, and the dimming controller 734, not being limited thereto. According to embodiments, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Functional aspects of the above embodiments may be implemented in algorithms that execute on one or more processors.

While the embodiments have been illustrated and described above, it will be apparent to those skilled in the art that modifications and variations could be made without departing from the scope of the present disclosure as defined by the appended claims.

What is claimed is:

1. A light emitting diode (LED) control device, comprising:

a power supply connected to a first driving node and a second driving node of an LED driver configured to provide driving power to a light source comprising a plurality of LEDs;

a controller configured to operate by a first internal power voltage output from the power supply, and receive a control command from an external controller; and a switching device connected to the second driving node, and configured to operate by a second internal power voltage output from the power supply and control brightness of the light source based on a control signal which is output from the controller in response to the control command.

2. The LED control device of claim 1, wherein the switching device comprises a switch connected between the light source and the second driving node, and a switch driver configured to control the switch in response to the control signal.

3. The LED control device of claim 2, wherein the switch driver is configured to output, to the switch, a pulse width modulation (PWM) signal having a frequency and a duty ratio determined by the control signal.

4. The LED control device of claim 2, wherein the controller is configured to adjust a duty ratio of a pulse width modulation (PWM) signal which is output to the switch from the switch driver, in response to a dimming command included in the control command.

5. The LED control device of claim 4, wherein the controller is configured to increase a duty ratio of the PWM signal based on the dimming command being a brightness increase command, and decrease the duty ratio of the PWM signal based on the dimming command being a brightness decrease command.

6. The LED control device of claim 1, further comprising a current sensing circuit connected to the first driving node and configured to generate a sensing voltage by detecting a driving current input to the light source, wherein the controller is configured to determine whether flicker occurs in the light source by comparing an amount of fluctuation of the sensing voltage with a reference value.

7. The LED control device of claim 6, wherein the controller is configured to change an operating frequency of a switch included in the switching device and connected to the second driving node when the amount of fluctuation of the sensing voltage exceeds the reference value.

8. The LED control device of claim 1, wherein the power supply comprises a first regulator configured to generate the first internal power voltage, and a second regulator configured to generate the second internal power voltage, and wherein the first internal power voltage and the second internal power voltage have different magnitudes.

9. The LED control device of claim 8, wherein the first internal power voltage is less than the second internal power voltage.

10. The LED control device of claim 1, wherein the switching device includes a first switch and a second switch connected in parallel with each other between the second driving node and the light source, and wherein, when the first switch is turned on, the second switch is turned off, and when the second switch is turned on, the first switch is turned off.

11. The LED control device of claim 10, wherein the switching device comprises a bleeder resistor connected between the second switch and the second driving node or between the second switch and the light source.

12. The LED control device of claim 11, wherein the first switch and the second switch are configured to be controlled by a single pulse width modulation (PWM) signal.

13. The LED control device of claim 10, wherein the first switch is configured to be controlled by a first PWM signal, and the second switch is configured to be controlled by a second PWM signal having a phase opposite to a phase of the first PWM signal and having a magnitude different from a magnitude of the first PWM signal.

14. The LED control device of claim 1, further comprising a dimming switching device connected to a dimming control terminal of the LED driver, and configured to output a dimming control voltage to the dimming control terminal, wherein the dimming switching device is configured to convert the control signal generated by the controller into a dimming control voltage, and output the dimming control voltage to the dimming control terminal.

15. A lighting device, comprising:

a light emitting diode (LED) driver configured to generate driving power for driving LEDs using AC power, and output the driving power through a first driving node and a second driving node;

a light source comprising at least one LED string comprising the LEDs, and connected between the first driving node and at least one LED node; and an LED control device connected to the first driving node, the second driving node, and the LED node, between the LED driver and the light source, wherein the LED control device comprises a controller connected to communicate with an external controller, a switching device connected between the LED node and the second driving node and configured to control the LED string in response to a control signal output from the controller, and a power supply connected to the first driving node and the second driving node and configured to output an internal power voltage for operation of the controller and the switching device.

16. The LED control device of claim 15, wherein the LED driver comprises a rectifier circuit configured to rectify the AC power, and a converter circuit configured to generate the driving power using an output of the rectifier circuit.

17. The LED control device of claim 15, wherein the LED driver comprises a first dimming control terminal and a second dimming control terminal different from the first driving node and the second driving node, and configured to adjust a magnitude of a current output to the first driving node based on a dimming control voltage input to the first dimming control terminal and the second dimming control terminal, and wherein the LED control device further comprises a dimming switching device configured to output the dimming control voltage in response to the control signal.

18. The LED control device of claim 15, wherein the switching device comprises a first switch and a second switch connected in parallel with each other between the LED node and the second driving node, and wherein the controller is configured to alternately turn on the first switch and the second switch while the light source operates.

19. The LED control device of claim 18, wherein the first switch is directly connected to the LED node and the second driving node, and wherein the second switch is connected to at least one of the LED node and the second driving node through a resistor or an inductor.

20. A light emitting diode (LED) control device, comprising:

a power supply connected to a first output terminal and a second output terminal among a plurality of output terminals included in an output harness of an LED driver, and configured to generate a first internal power voltage and a second internal power voltage using driving power output by the LED driver;

a controller configured to operate by the first internal power voltage and generate a pulse width modulation (PWM) signal as a control signal, based on a control command received from an external controller; and a switching device connected to the second output terminal, configured to operate by the second internal power voltage, and adjust brightness of at least one of a plurality of LEDs operating by the driving power based on the control signal.

* * * * *